US012036459B1

(12) United States Patent
Force

(10) Patent No.: US 12,036,459 B1
(45) Date of Patent: Jul. 16, 2024

(54) CORNHOLE LEVELING SYSTEM

(71) Applicant: John Force, Erin, NY (US)

(72) Inventor: John Force, Erin, NY (US)

( * ) Notice: Subject to any disclaimer, the term of this patent is extended or adjusted under 35 U.S.C. 154(b) by 0 days.

(21) Appl. No.: 18/478,673

(22) Filed: Sep. 29, 2023

(51) Int. Cl.
*A63B 67/06* (2006.01)

(52) U.S. Cl.
CPC ..... *A63B 67/06* (2013.01); *A63B 2225/02* (2013.01); *A63B 2225/093* (2013.01)

(58) Field of Classification Search
CPC ..... A63B 67/06; A63B 2225/02; A63B 2225/093
See application file for complete search history.

(56) References Cited

U.S. PATENT DOCUMENTS 5,056,796 A * 10/1991 Conville ..... A63B 67/06 273/402
11,173,363 B1 * 11/2021 Pontrelli ..... A63B 67/06
2008/0042360 A1 * 2/2008 Veikley ..... A63B 67/06 273/398
2014/0091526 A1 * 4/2014 Nally ..... A63B 63/08 273/402
2015/0054221 A1 * 2/2015 Sandman ..... A63B 60/16 273/402
2015/0091249 A1 * 4/2015 Nally ..... A63F 7/0652 273/108.1
2016/0045799 A1 * 2/2016 Gallagher ..... A63B 63/007 273/335
2017/0095715 A1 * 4/2017 Maginnis ..... A63B 67/02
2019/0344142 A1 * 11/2019 Modlin ..... A63B 67/06
2020/0129835 A1 * 4/2020 Clark ..... A63B 67/06
2020/0298079 A1 * 9/2020 Mullins ..... A63B 71/0669
2021/0060399 A1 * 3/2021 Dingel ..... A63B 67/06
2022/0105402 A1 * 4/2022 Donnelly ..... A63B 67/06
2022/0280851 A1 * 9/2022 Petrarca ..... A63B 67/06

* cited by examiner

*Primary Examiner* — Eugene L Kim
*Assistant Examiner* — Christopher Glenn
(74) *Attorney, Agent, or Firm* — Brown & Michaels, PC

(57) ABSTRACT

Kits for leveling and adjusting the slope of cornhole boards as well as a method leveling and adjusting the cornhole boards.

20 Claims, 27 Drawing Sheets

79

78

70

71

CORNHOLE LEVELING SYSTEM

BACKGROUND

The present invention relates to cornhole boards, and more specifically to a cornhole board leveling system.

Cornhole is a lawn game in which players or teams take turns throwing fabric bean bags or other items at a raised, angled board with a hole at an end. FIG. 1 shows a typical cornhole board 10. A single cornhole board 10 is preferably 2 by 4 feet (0.61 by 1.22 m), with a 6-inch (150 mm) diameter hole 3. The cornhole board 10 has a first end 2*a* opposite a second end 2*b*, and a top surface 2*c* opposite the bottom surface 2*d*, and two side surfaces 2*h*. The side surfaces 2*h* have a top edge 2*i* and a bottom edge 2*j*. Legs 4, 5 are attached to the second end 2*b*. A hole 3 is present along the top surface 2*c* and extends from the top surface 2*c* through to the bottom surface 2*d*. The hole's center is positioned 9 inches (230 mm) down from the center of the edge 2*e* of the board.

The legs 4, 5 have a first end 4*a*, 5*a* connected to the bottom 2*d* surface of the board 10 and the second end 4*b*, 5*b* which contacts the ground 6. It is noted that there is space between the legs 4, 5 and a back edge 2*g* of the second end 2*b* of the cornhole board 10. The second end 2*b* of the board 10 is a greater distance from the ground than the first end 2*a*. The legs 4, 5 are typically made of boards with a thickness of 1.5 inches (38.1 mm) or less and a maximum width of 3.5 inches (88.9 mm) since the boards are typical 2 ft (60.96 cm)×4 ft (121.92 cm). The front edge 2*f* of the first end 2*a* contacts the ground.

Each board 10 is angled with the back edge 2*e* of the playing surface 12 inches (300 mm) above the ground, and the front edge 2*f* three to four inches (76-102 mm) above the ground with an angle of 10 degrees. A standard court places the two boards 33 feet (10 m) or 27 feet (8.2 m) apart, measuring from the front edge 2*f* of the boards. The boards are often set up on a lawn which is not level, making placement and angling of the boards appropriately and fairly very difficult.

SUMMARY

According to one embodiment of the present invention, a kit for leveling one or more cornhole boards is disclosed. The kit comprises: at least one pair of back leg bracket assemblies and one or more front leg bracket assemblies.

The back leg bracket assemblies comprising: a right leg bracket assembly and a left leg bracket assembly. The right leg bracket assembly has a right leg having a right leg portion connected to a right leg base portion at a first angle; a right back leg bracket guide having a right leg guide body defining a closed end bore adapted to receive a right leg of a back of one or more cornhole boards and connected to a right leg guide defining a right leg through bore and a right leg screw bore perpendicular to and connected to the right leg through bore adapted to receive a screw; wherein the right leg portion of the of the right leg is received within the right leg through bore, such that the right leg guide is vertically adjustable about the right leg portion. The left leg bracket assembly has a left leg having a left leg portion connected to a left leg base portion at a second angle; a left back leg bracket guide having a left leg guide body defining a closed end bore adapted to receive a left leg of a back of one or more cornhole boards and connected to a left leg guide defining a left leg through bore and a left leg screw bore perpendicular to and connected to the left leg through bore adapted to receive a screw; wherein the left leg portion of the of the left leg is received within the left leg through bore, such that the left leg guide is vertically adjustable about the left leg portion; and The one or more front leg bracket assemblies each comprises: a front leg having a front leg portion connected to a front leg base portion at a third angle; and a front leg bracket guide body defining a closed end bore adapted to receive a front edge of the at least one cornhole boards comprising a guide body defining a guide body closed end bore and connected to front leg bracket leg guide defining a through bore and a screw bore perpendicular to and connected to the through bore to receive a screw; wherein the front leg portion of the of the front leg is received within the through bore, such that the front leg bracket guide is vertically adjustable about the front leg.

The kit can also include a collapsible reducing wedge for insertion within the right leg guide body and/or the left leg guide body, a reducing shim for insertion within the one or more front leg bracket assemblies and a horizontal and angle slope level. It is noted that the reducing shims are used for legs that are less than 1.5 inches (38.1 mm) in width.

According to another embodiment of the present invention, a kit for leveling one or more cornhole boards is disclosed. The kit comprises: at least one pair of back leg bracket assemblies, one or more front leg bracket assemblies, an alignment cable and alignment clips.

The back leg bracket assemblies comprising: a right leg bracket assembly and a left leg bracket assembly. The right leg bracket assembly has a right leg having a right leg portion connected to a right leg base portion at a first angle; a right back leg bracket guide having a right leg guide body defining a closed end bore adapted to receive a right leg of a back of one or more cornhole boards and connected to a right leg guide defining a right leg through bore and a right leg screw bore perpendicular to and connected to the right leg through bore adapted to receive a screw; wherein the right leg portion of the of the right leg is received within the right leg through bore, such that the right leg guide is vertically adjustable about the right leg portion. The left leg bracket assembly has a left leg having a left leg portion connected to a left leg base portion at a second angle; a left back leg bracket guide having a left leg guide body defining a closed end bore adapted to receive a left leg of a back of one or more cornhole boards and connected to a left leg guide defining a left leg through bore and a left leg screw bore perpendicular to and connected to the left leg through bore adapted to receive a screw; wherein the left leg portion of the of the left leg is received within the left leg through bore, such that the left leg guide is vertically adjustable about the left leg portion.

The one or more front leg bracket assemblies each comprises: a front leg having a front leg portion connected to a front leg base portion at a third angle; and a front leg bracket guide body defining a closed end bore adapted to receive a front edge of the at least one cornhole boards comprising a guide body defining a guide body closed end bore and connected to front leg bracket leg guide defining a through bore and a screw bore perpendicular to and connected to the through bore to receive a screw; wherein the front leg portion of the of the front leg is received within the through bore, such that the front leg bracket guide is vertically adjustable about the front leg.

The alignment cable has a first end and a second end separated by a length, the first end and the second end each having a retainer.

The left side alignment clip is adapted to mount to a left side of the first cornhole board. The left side alignment clip comprises: a left side alignment clip body with an a left side alignment clip first portion having a first end, a second end opposite the first end, a first side and a second side opposite the first side, a left side alignment clip second portion connected to the left side alignment clip first portion at the first end on the first side; and a left side alignment clip third portion connected to the left side alignment clip first portion at the second end on the second side defining at least one left side alignment piece.

The right side alignment clip adapted to mount to a right side of the second cornhole board. The right side alignment clip comprises: a right side alignment clip body with an a right side alignment clip first portion having a first end, a second end opposite the first end, a first side and a second side opposite the first side, a right side alignment clip second portion connected to the right side alignment clip first portion at the first end on the first side; and a right side alignment clip third portion connected to the right side alignment clip first portion at the second end on the second side defining at least one right side alignment piece.

The kit can also include a collapsible reducing wedge for insertion within the right leg guide body and/or the left leg guide body, a reducing shim for insertion within the one or more front leg bracket assemblies and a horizontal and angle slope level. It is noted that the reducing shims are used for legs that are less than 1.5 inches (38.1 mm) in width.

A method of leveling of aligning and leveling a first cornhole board and a second cornhole board for playing on uneven ground is also disclosed.

DETAILED DESCRIPTION

Figure 1:
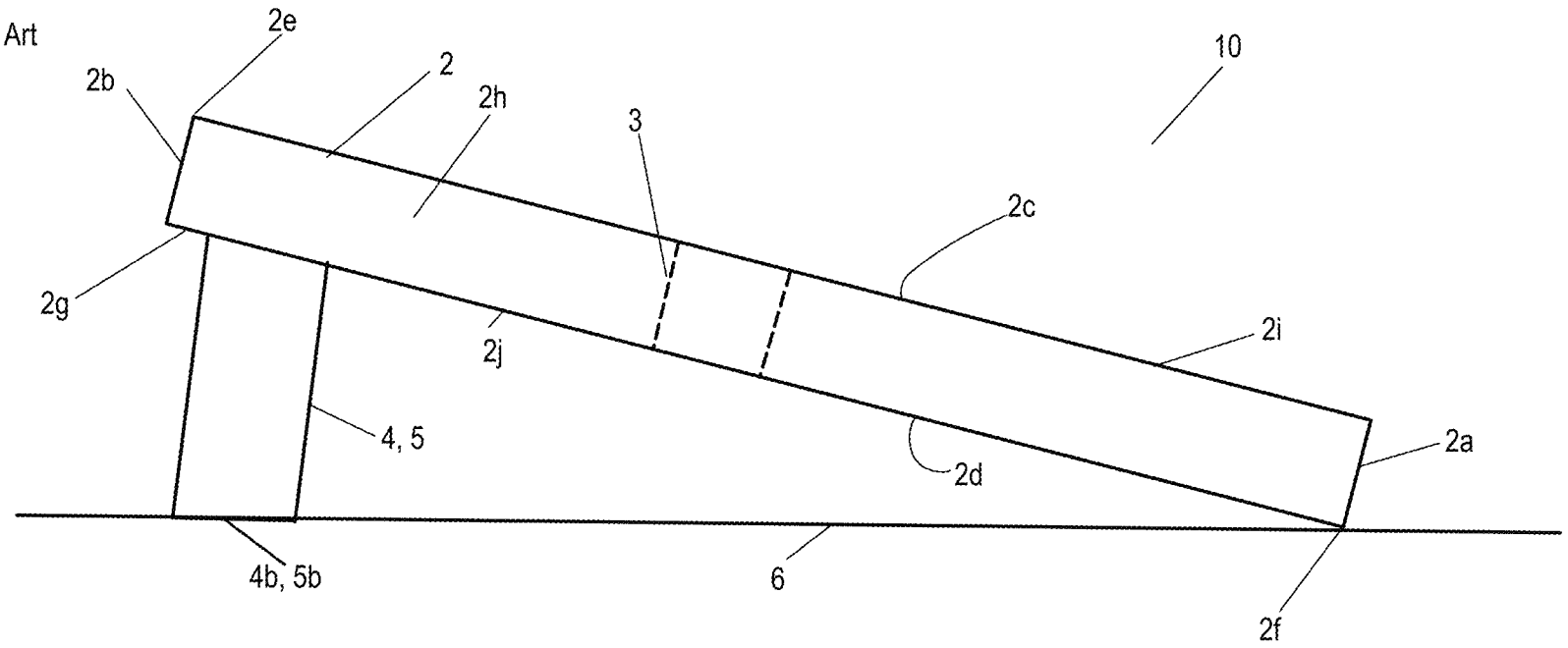
Fig. 1 Prior Art
FIG. 1 shows an example of a cornhole board.
Figure 2:
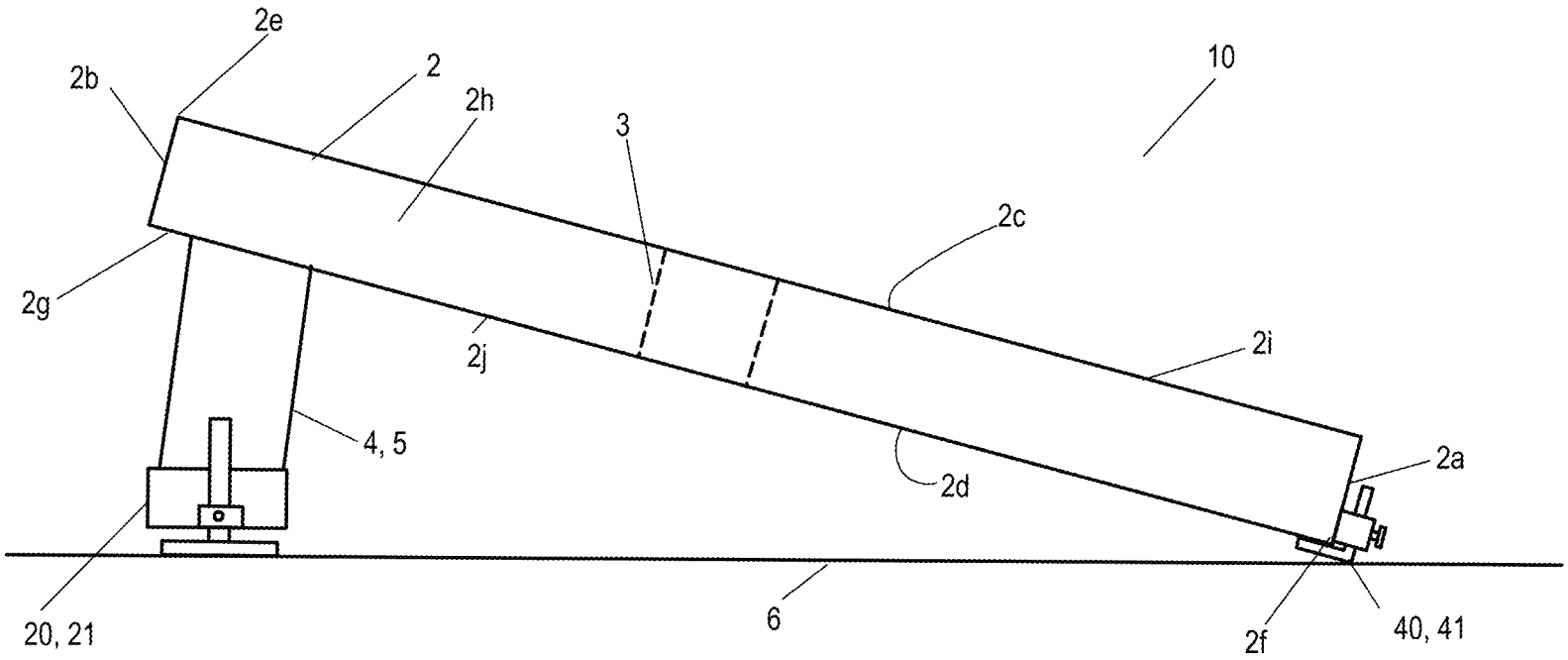
FIG. 2 shows a cornhole board with a bracket leveling system.
Figure 4:
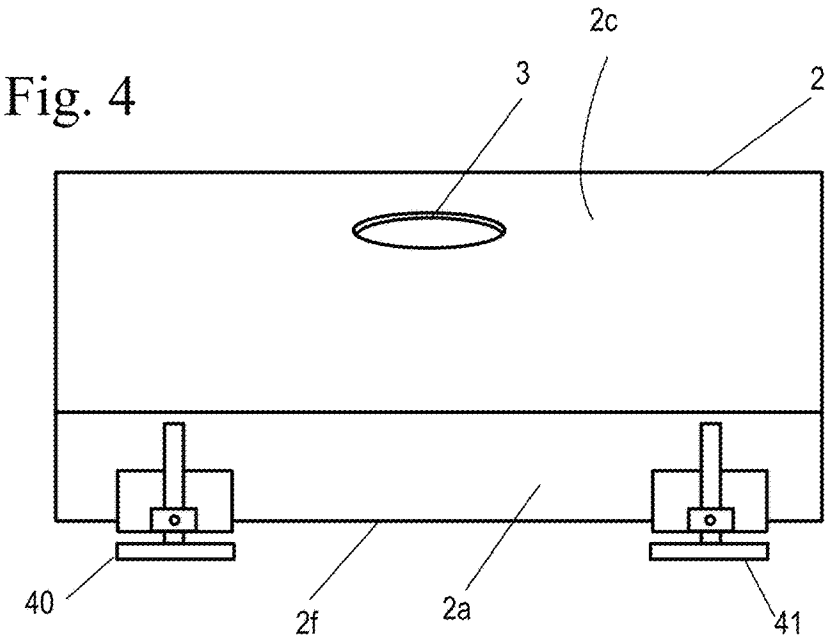
FIG. 4 shows a second end view of the cornhole board with the bracket leveling system.
Figure 3:
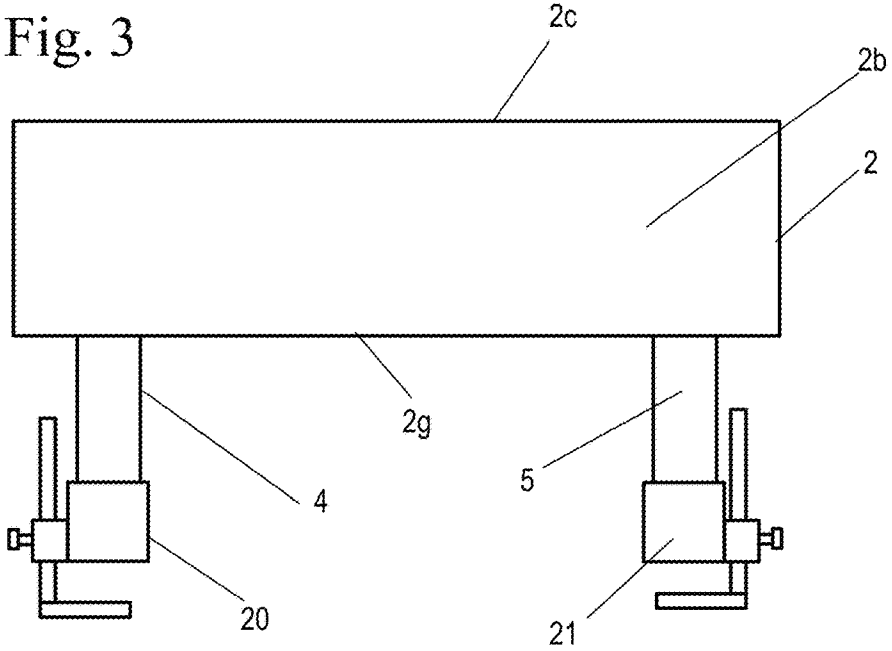
FIG. 3 shows a first end view of the cornhole board with the bracket leveling system.

FIGS. 2-4 show a corn hole board 10 with front leg bracket assemblies 40, 41 on the first end or front end 2*a* and back leg bracket assemblies 20, 21 on the second end or back end 2*b* to level the corn hole board 10 relative to the ground 6. Both the back leg bracket assemblies 20, 21 and the front leg bracket assemblies 40, 41 are individually adjustable to raise or lower the front end 2*a* or back end 2*b* of the corn hole board 10.

FIGS. 5*a*-11*c* show the back leg bracket assemblies 20, 21. The right back leg bracket assembly 20 has a right leg 22 of a leg portion 24 and a base portion 23 as shown in FIGS. 6*a*-6*d* and a right back leg bracket guide 29 shown in FIGS. 7*a*-8*c*. The left back leg bracket assembly 21 has a left leg 29 of a leg portion 25 and a base portion 26 as shown in FIGS. 9*a*-9*d* and a left back leg bracket guide 30 shown in FIGS. 10*a*-11*c*.

The base portion 23 of the right leg 22 has a first surface 23*a* and a second surface 23*b*, opposite the first surface 23*a*. The second surface 23*b* contacts the ground 6. The leg portion 24 has a first end 24*a* and a second end 24*b*. The second end 24*b* of the leg portion 23 is attached to the first surface 23*a* of the base portion 23 at an angle alpha. The angle alpha is preferably between 20-30 degrees. More preferably, the angle alpha is 27 degrees.

Referring to FIGS. 7*a*-8*c*, the right back leg bracket guide 29 has a guide body 27 defining a closed end bore 27*a* and is connected to a leg guide 28. The leg guide 28 defines a through bore 28*a* and a screw bore 28*b* perpendicular to and connected to the through bore 28*a*.

The leg guide 28 is fixed to the guide body 27 at the same angle alpha as the right leg 22 to the base portion 23. The screw bore 28*b* receives a screw 33 that abuts the right leg 22 received within the through bore 28*a*.

The base portion 26 of the left leg 29 has a first surface 26*a* and a second surface 26*b*, opposite the first surface 26*a*. The second surface 26*b* contacts the ground 6. The leg portion 25 has a first end 25*a* and a second end 25*b*. The second end 25*b* of the leg portion 25 is attached to the first surface 26*a* of the base portion 26 at an angle beta. The angle beta is preferably between 20-30 degrees. More preferably, the angle beta is 27 degrees. In one embodiment, the angle alpha equals the angle beta.

Referring to FIGS. 9*a*-11*c*, the left back leg bracket guide 30 has a guide body 31 defining a closed end bore 31*a* and is connected to a leg guide 32. The leg guide 32 defines a through bore 32*a* and a screw bore 32*b* perpendicular to and connected to the through bore 31*a*. The leg guide 31 is fixed to the guide body 32 at the same angle beta as the left leg 29 to the base portion 26. The screw bore 32*b* receives a screw 33 that abuts the left leg 29 received within the through bore 31*a*.

Figures 5A, 5B:
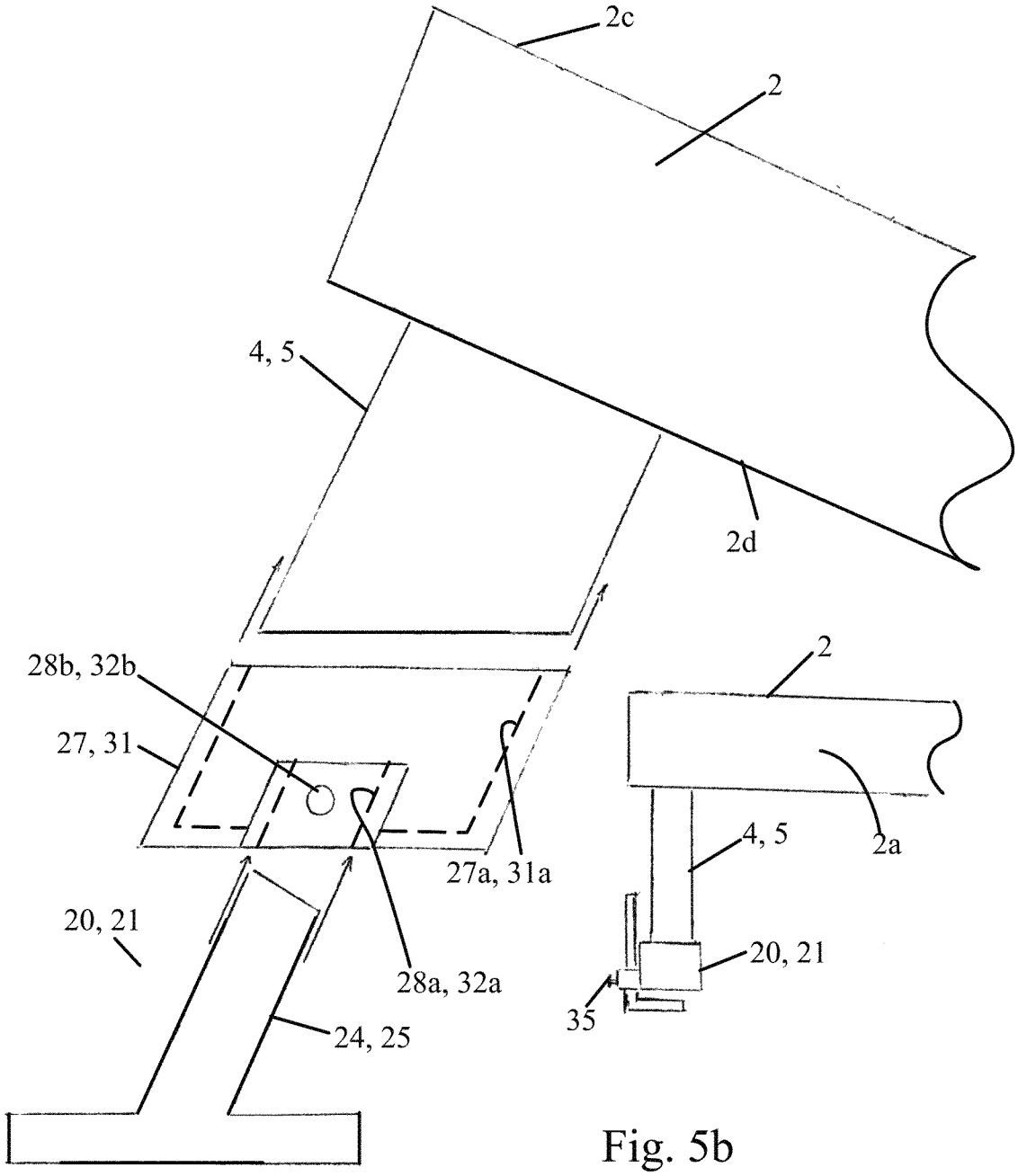
FIG. 5*a* shows an exploded view of bracket assembly on a first end cornhole board with the bracket leveling system.
FIG. 5*b* shows a bracket assembly on a first end of the cornhole board.
Figure 6B:
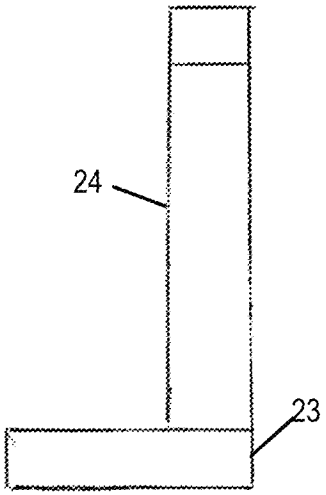
FIG. 6*b* shows a front view of the right leg of the bracket assembly.
Figure 6D:
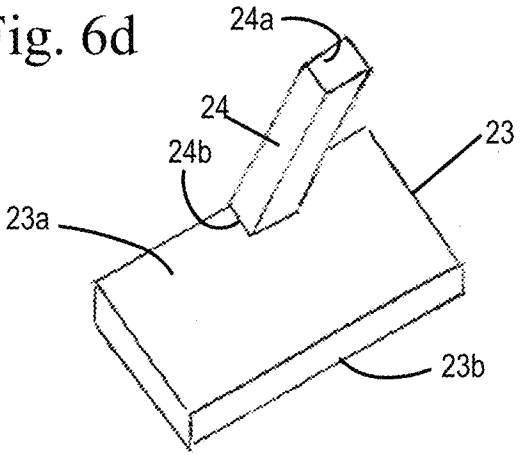
FIG. 6*d* shows a perspective view of the right leg of the bracket assembly.
Figure 6A:
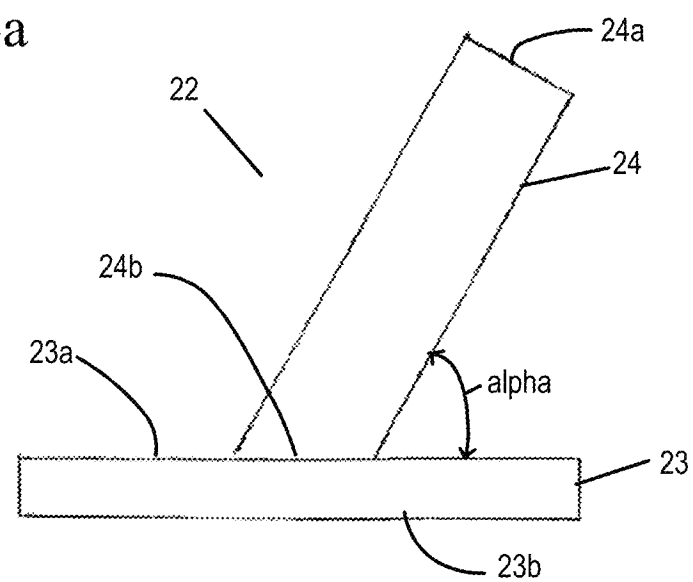
FIG. 6*a* shows a side view of the right leg of the bracket assembly.
Figure 6C:
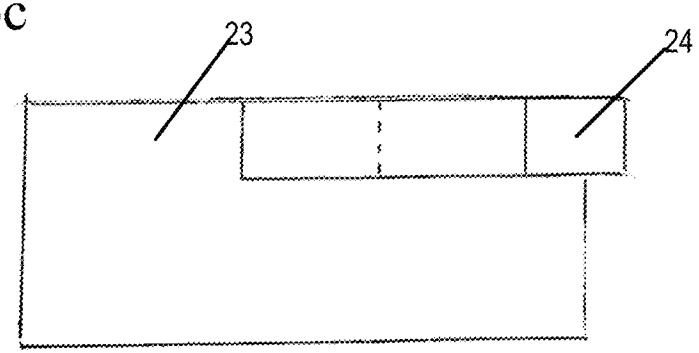
FIG. 6*c* shows a top view of the right leg of the bracket assembly.
Figure 7A:
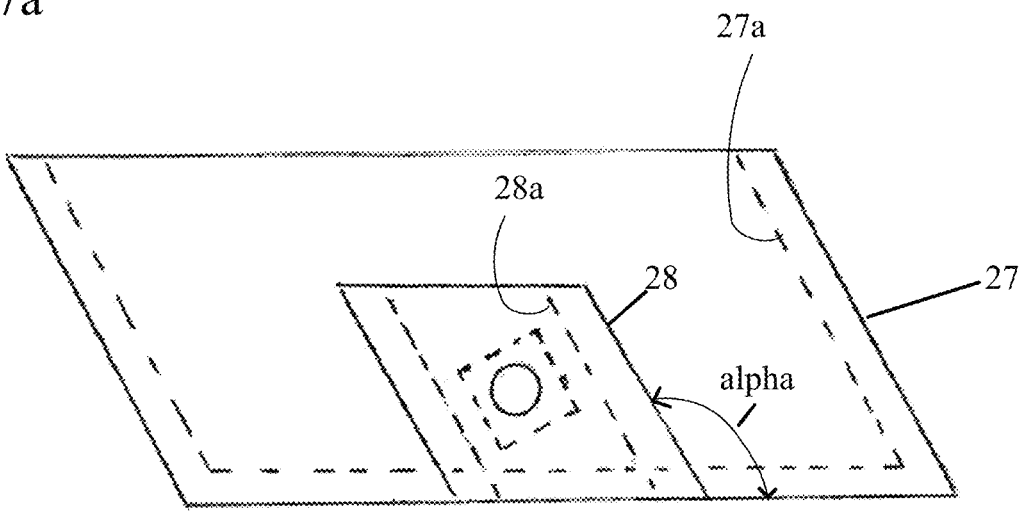
FIG. 7*a* shows a front view of the right leg bracket.
Figure 7B:
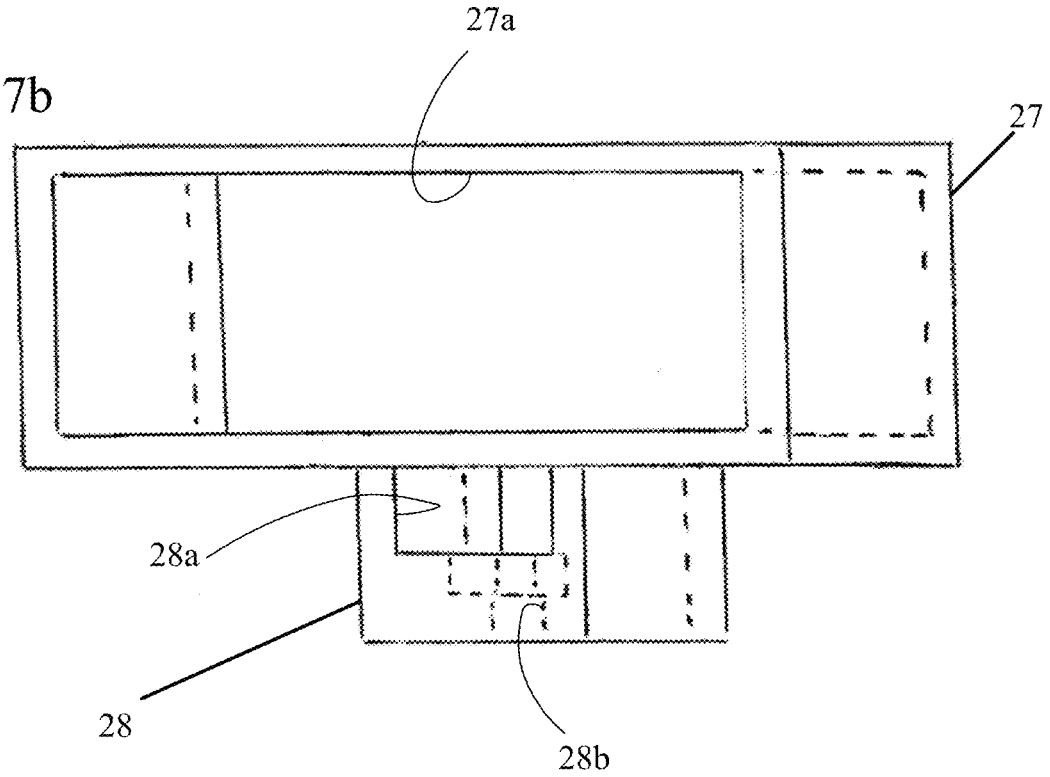
FIG. 7*b* shows a top view of the right leg bracket.
Figure 8B:
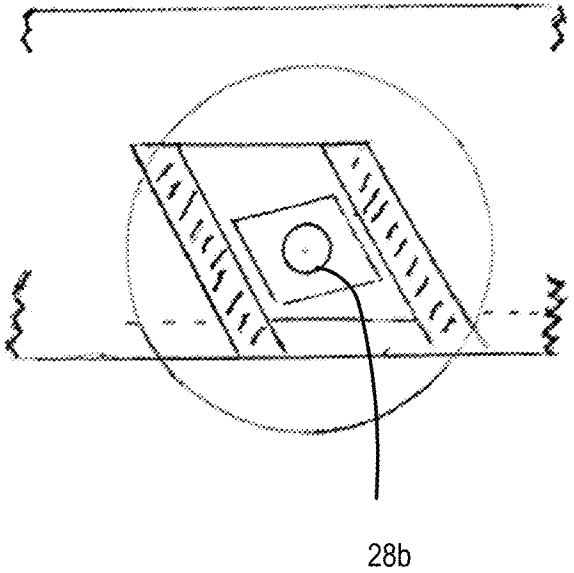
FIG. 8*b* shows a cut away of the right leg guide.
Figure 8A:
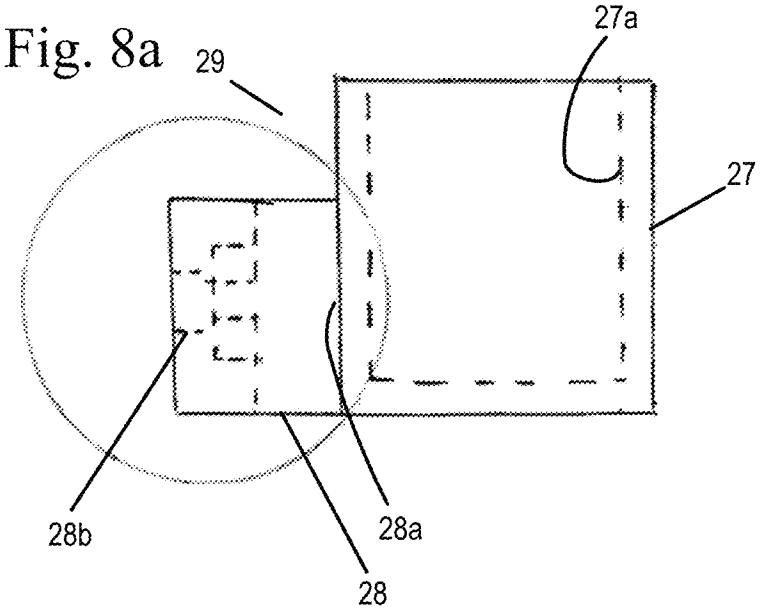
FIG. 8*a* shows a side view of the right leg bracket.
Figure 8C:
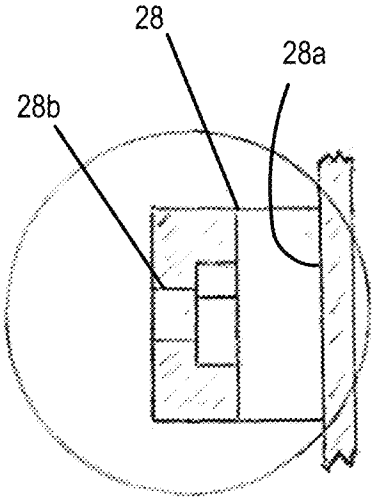
FIG. 8*c* shows a cut away of the right bracket.
Figure 9B:
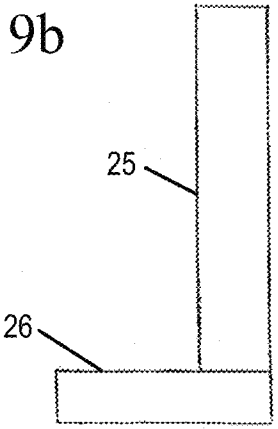
FIG. 9*b* shows a front view of the left leg bracket assembly.
Figure 9D:
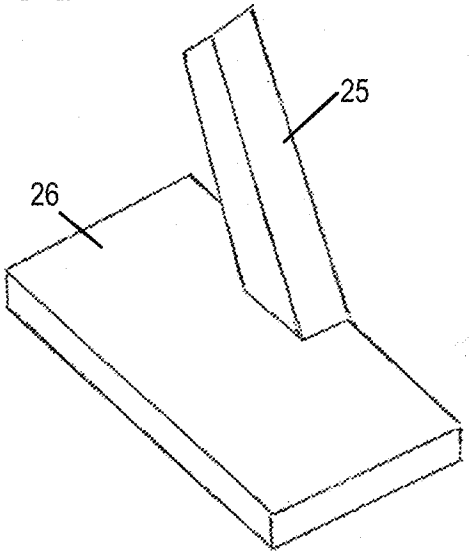
FIG. 9*d* shows a perspective view of the left leg bracket assembly.
Figure 9A:
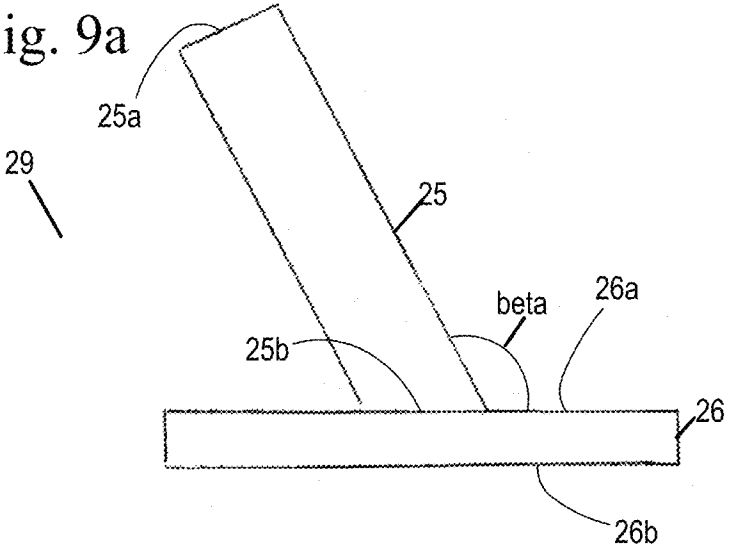
FIG. 9*a* shows a side view of the left leg bracket assembly.
Figure 9C:
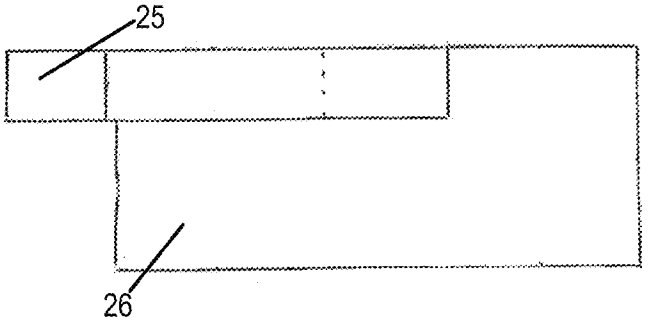
FIG. 9*c* shows a top view of the left leg bracket assembly.
Figure 10A:
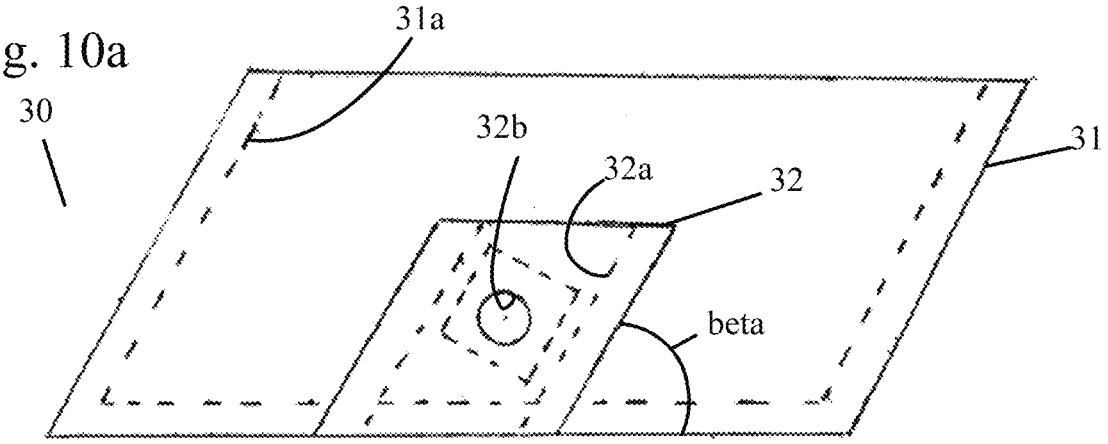
FIG. 10*a* shows a front view of the left leg bracket.
Figure 10B:
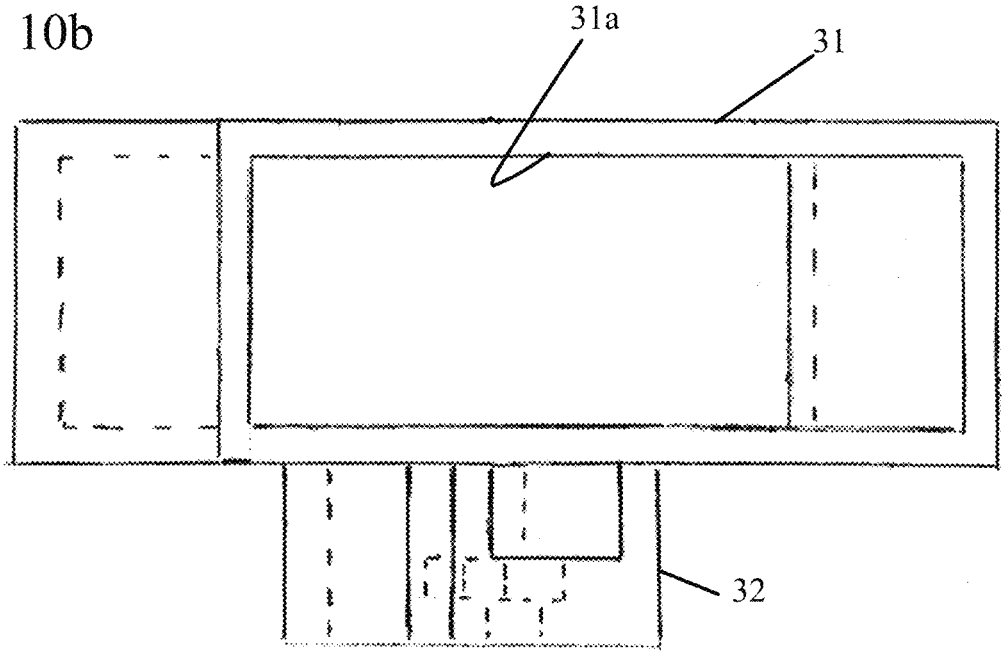
FIG. 10*b* shows a top view of the left leg bracket.
Figure 11B:
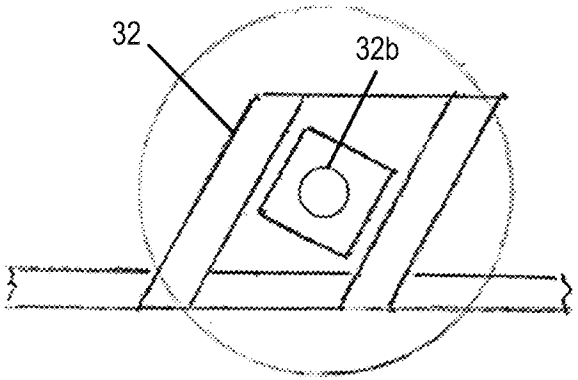
FIG. 11*b* shows a cut away of the left leg guide.
Figure 11A:
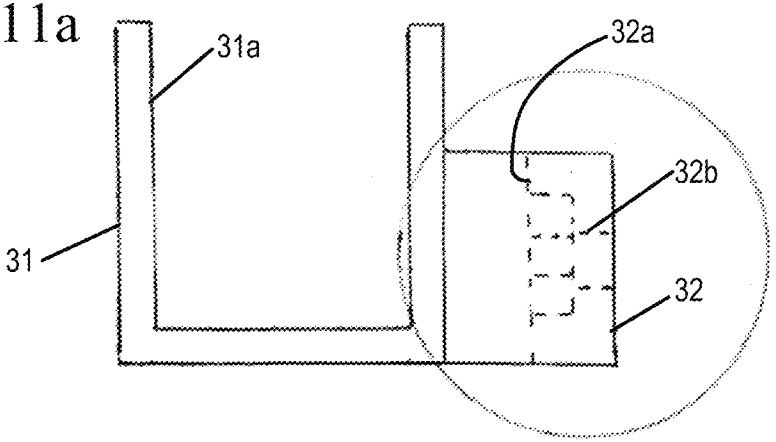
FIG. 11*a* shows a side view of the left leg bracket.
Figure 11C:
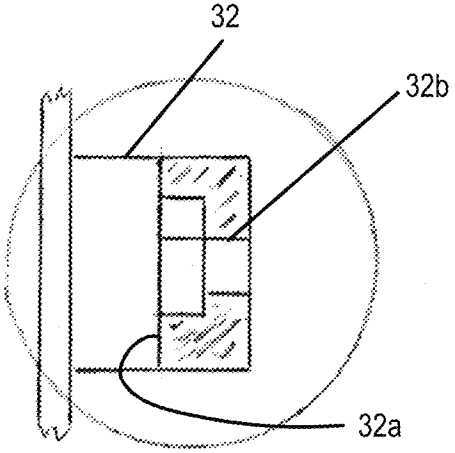
FIG. 11*c* shows a cut away of the left leg bracket.

As shown in FIG. 5*a*, the legs 4, 5 of the cornhole board 10 are inserted into bore 27*a*, 31*a* of the guide bodies 27, 31. The leg portion 24, 25 is inserted into the through bore 28*a*, 32*a*. A screw 35 is received within the screw bore 28*b*, 32*b*. The height of the leg 4, 5 is adjusted by moving the guide body 27, 31 along the length of the leg portion 24, 25 and fixed in place with the screw 35 which interacts with the leg 24, 25.

FIG. 5*b* shows an initial position in which the leg 4, 5, of the cornhole board 10 is at the least amount of height added to raise the back end 2*b* of the cornhole board 10.

Figure 13:
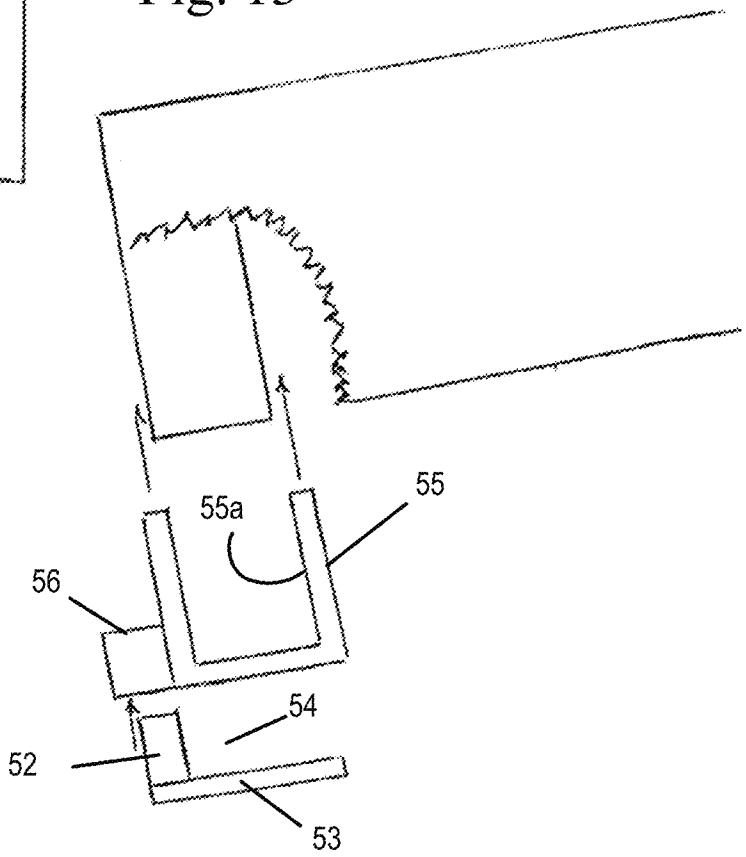
FIG. 13 shows a cut away of the insert bracket assembly on the second end of the board.
Figure 12:
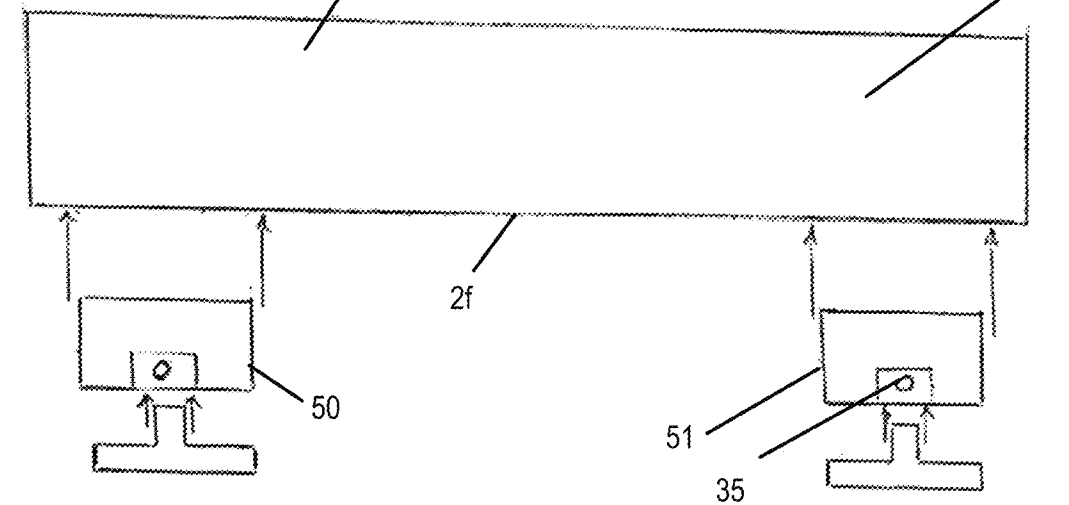
FIG. 12 shows a bracket assembly on the second end of the board.
Figure 14B:
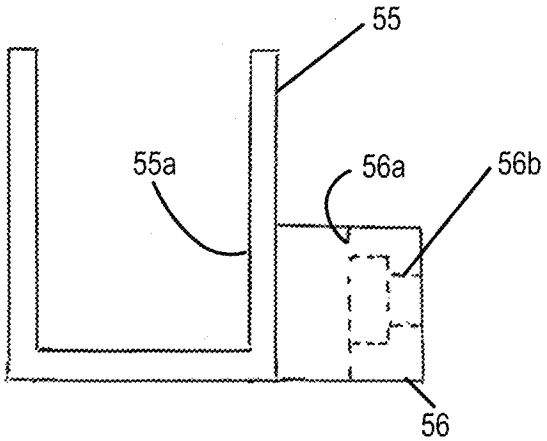
FIG. 14*b* shows a front view of the front leg bracket.
Figure 14D:
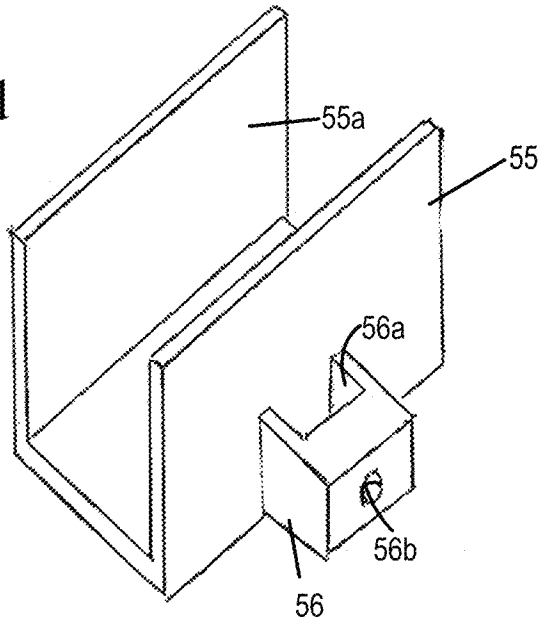
FIG. 14*d* shows a perspective view of the front leg bracket.
Figure 14A:
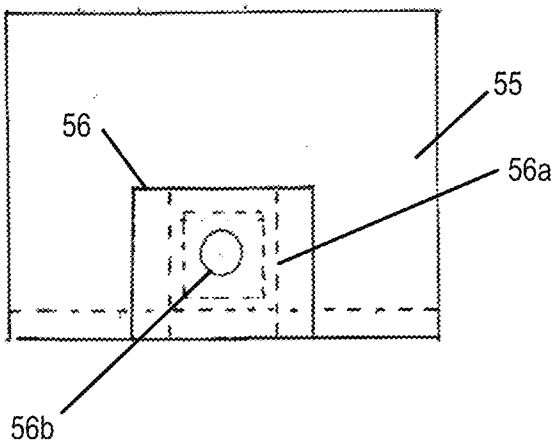
FIG. 14*a* shows a side view of the front leg bracket.
Figure 14C:
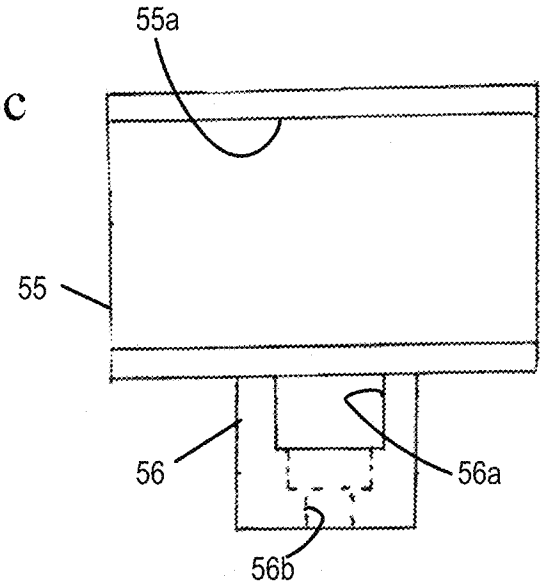
FIG. 14*c* shows a top view of the front leg bracket.
Figure 15B:
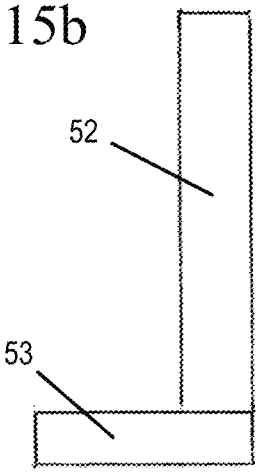
FIG. 15*b* shows a front view of the left leg of the front bracket assembly.
Figure 15D:
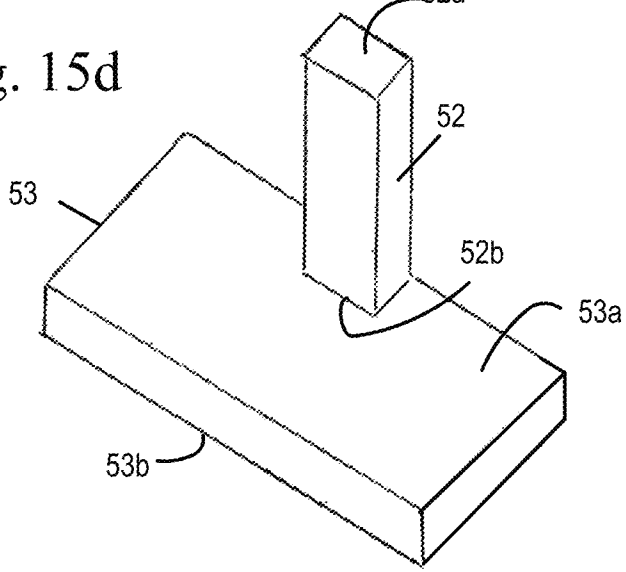
FIG. 15*d* shows a perspective view of the left leg of the front bracket assembly.
Figure 15A:
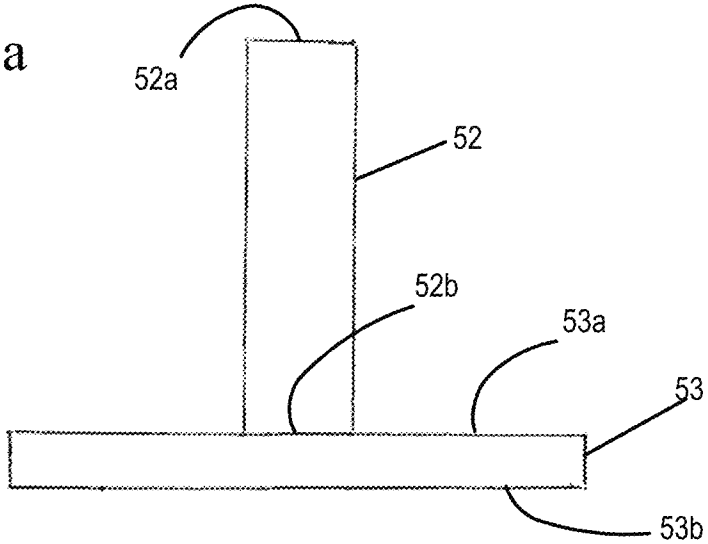
FIG. 15*a* shows a side view of the left leg of the front bracket assembly.
Figure 15C:
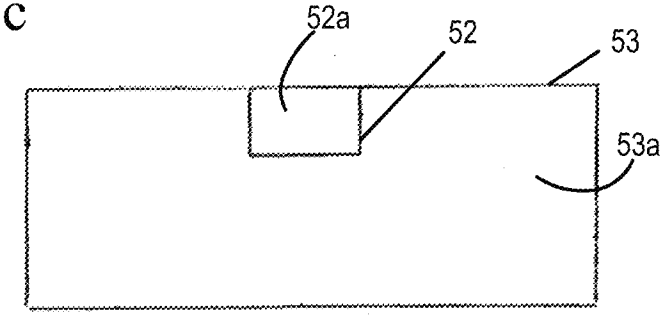
FIG. 15*c* shows a top view of the left leg of the front bracket assembly.

FIGS. 12-13 shows the front bracket assemblies 40, 41 which can be mounted to the first or front end 2*a* of the cornhole board 10. The front bracket assemblies 40, 41 engage at least a front edge 2*f* of the cornhole board 10. Referring to FIGS. 14*a*-14*d*, the front bracket assemblies 40, 41 each have a guide body 55 defining a closed ended bore 55*a* which receives the front edge 2*f*. It is noted that the front edge 2*f* can be a board with 2 inches (50.8 mm) or less of width. Attached to the guide body 55 is a leg guide 56. The leg guide 56 has a through hole 56*a* parallel to the closed end bore 55*a* of the guide body 55.

FIGS. 15*a*-15*d* show the front legs 54 of which a portion are received by the through hole 56*a* of the leg guide 56. The front legs 54 have a base portion 53 connected to a leg portion 52. The leg portion 52 has a first end 52*a* and a second end 52*b*. The base portion 53 has a first surface 53*a* and a second surface 53*b*, opposite the first surface 53*a*. The second surface 53*b* contacts the ground 6. The second end 52*b* of the leg portion 52 is attached to perpendicular to the first surface 53*a* of the base portion 53.

The height of the front end 2*a* of the cornhole board 10 can be raised and adjusted to different heights based on movement of the leg portion 52 within the through hole 56*a* of the leg guide 56.

FIGS. 17*a*-17*d* show a collapsible reducing wedge 60 that can be inserted between the left back leg 4 and the left back leg bracket guide 30 depending on the thickness of the left back leg 4. It is noted that the collapsible reducing wedge 60 is angled at an angle beta to match the leg guide 32 of the left leg bracket guide 30.

FIGS. 17*e*-17*h* shows a collapsible reducing wedge 63 that can be inserted between the right back leg 5 and the right back leg bracket guide 29 depending on the thickness of the right back leg 5. It is noted that the collapsible reducing wedge 63 is angled at an angle alpha to match the leg guide 28 of the right leg bracket guide 29.

If the thickness of the right and left back legs 4, 5 is not enough to fill the closed end bore 27*a*, 31*a*, the collapsible reducing wedge 60, 63 can be used as a shim to fill the closed end bore 27*a*, 31*a*. The collapsible reducing wedge 60, 63 each have a collapsible material 62 attached to a rigid shim plate 61. In a non-compressed state, the collapsible material has 62 a distance d3.

Figure 16B:
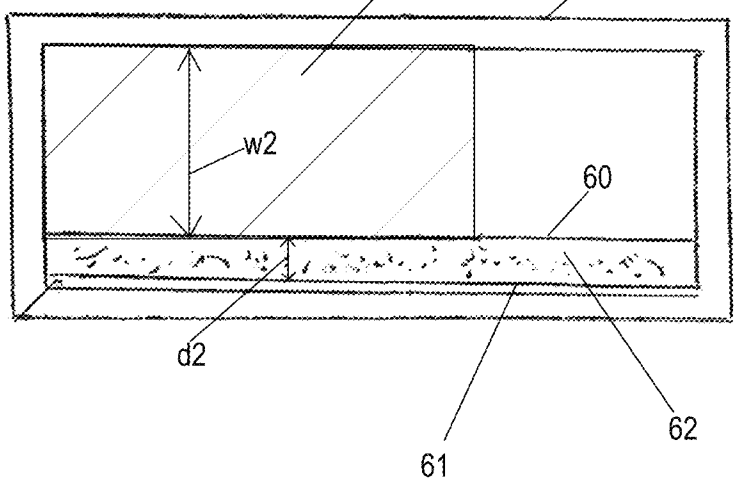
FIG. 16*b* shows a top view of the rear leg bracket with the shim installed with greater than 50% compression.
Figure 16A:
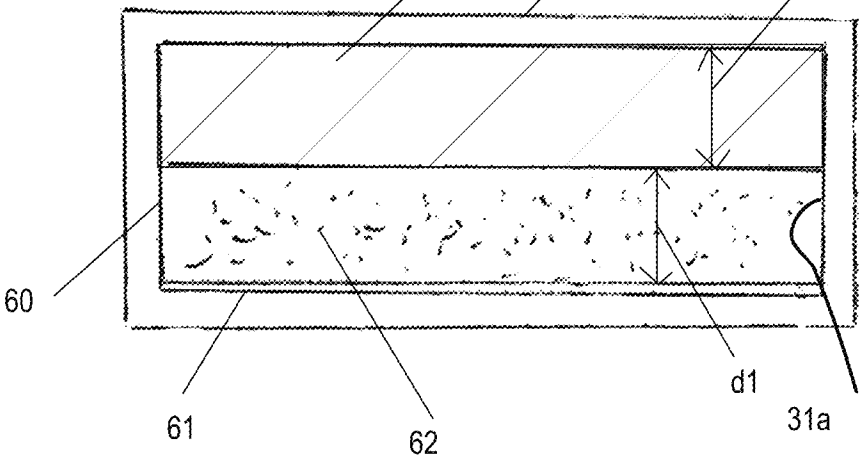
FIG. 16*a* shows a top view of the rear leg bracket with the shim installed with 50% compression to little compression.
Figure 17A:
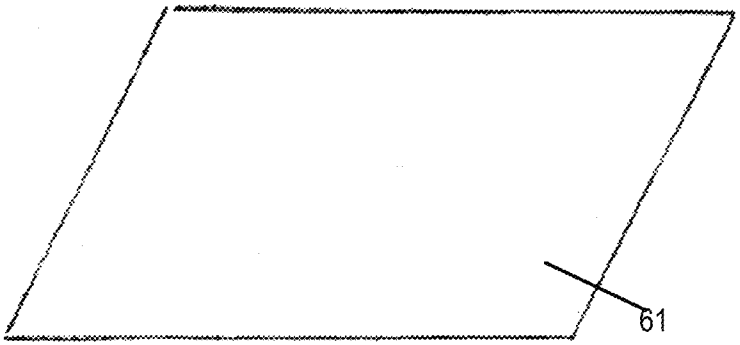
FIG. 17*a* shows a front view of the left rear leg shim at angle beta.
Figure 17B:
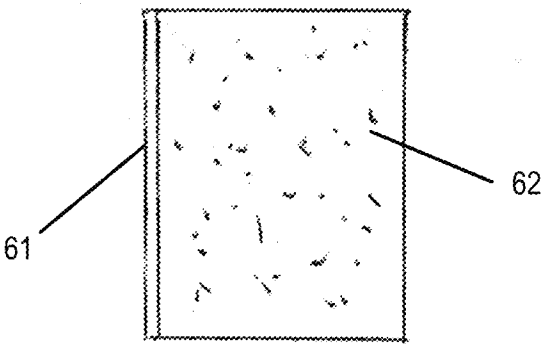
FIG. 17*b* shows a side view of the left rear leg shim at angle beta.
Figure 17C:
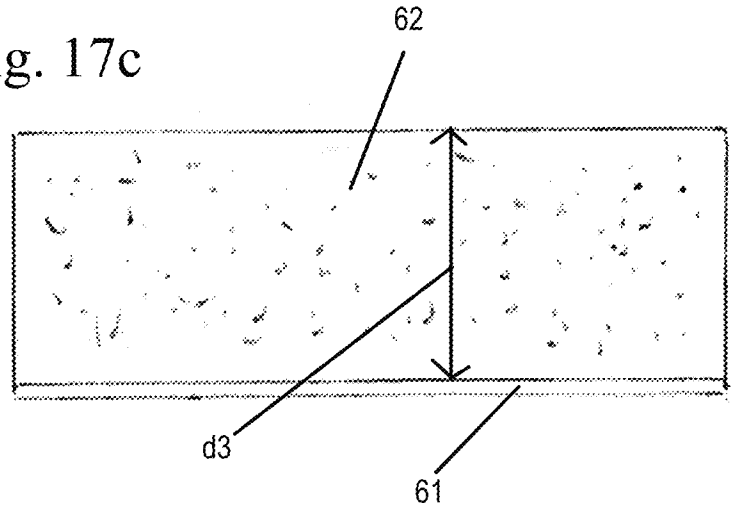
FIG. 17*c* shows a top view of the left rear leg shim at angle beta.
Figure 17D:
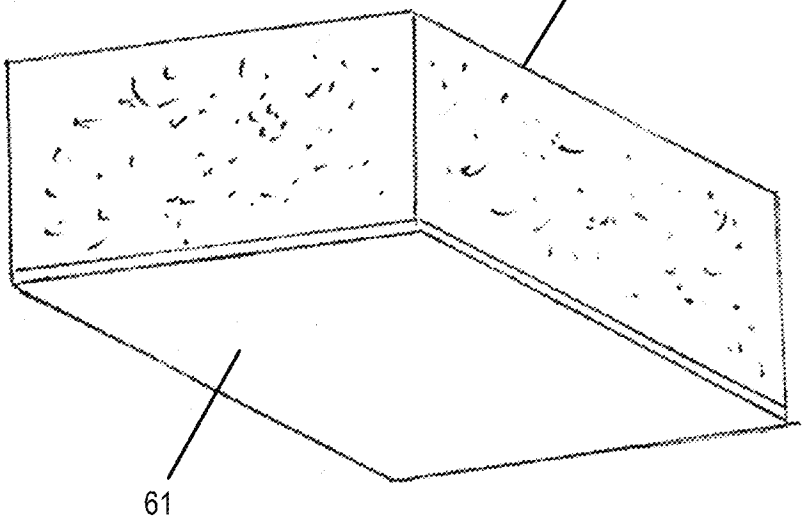
FIG. 17*d* shows a perspective view of the left rear leg shim at angle beta.
Figure 17F:
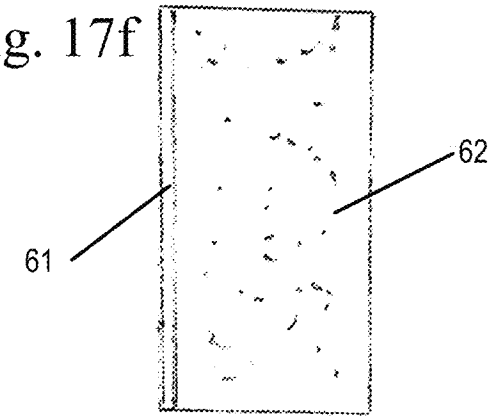
FIG. 17*f* shows a side view of the right rear leg shim at angle alpha.
Figure 17E:
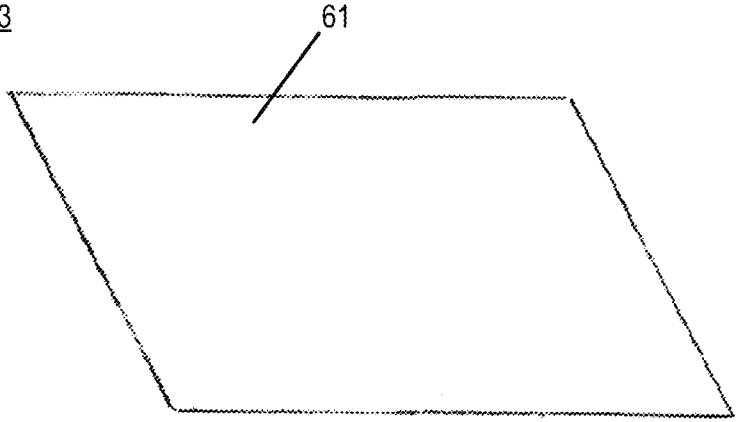
FIG. 17*e* shows a front view of the right rear leg shim at angle alpha.
Figure 17H:
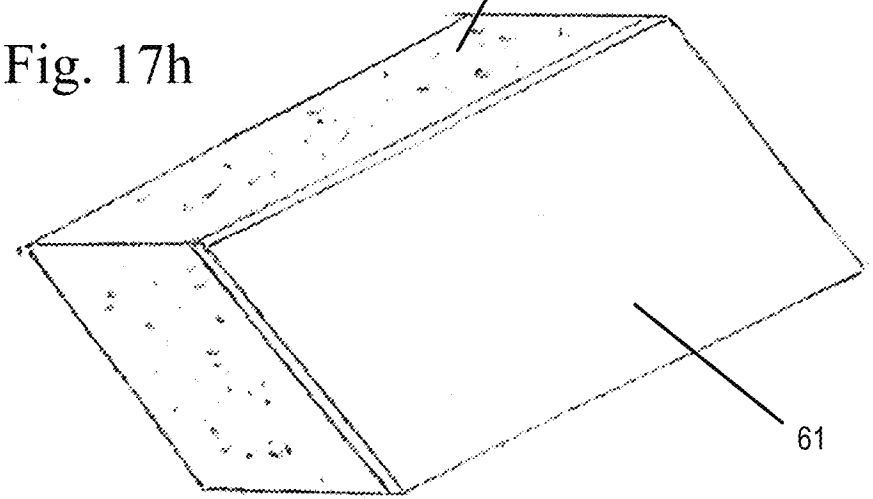
FIG. 17*h* shows a perspective view of the right rear leg shim at angle alpha.
Figure 17G:
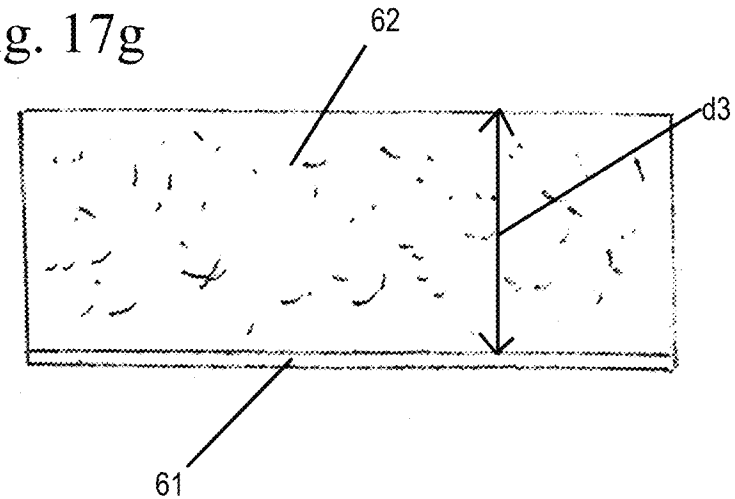
FIG. 17*g* shows a top view of the right rear leg shim at angle alpha.

FIG. 16*a* shows the board leg 4, 5 of a first thickness w1. The collapsible reducing wedge 60 is inserted within the closed end bore 27*a*, 31*a* adjacent to the board leg 4, 5, with the collapsible material reduced to a distance d1. In this figure the board leg 4, 5 has a thickness of approximately ¾ inch. FIG. 16*b* shows a board leg 4, 5 with a second thickness w2, greater than thickness w1, but still not a thickness large enough to fill the closed end bore 27*a*, 31*a*. The thickness of the board legs 4, 5 is greater than ¾ inch.

As shown, the collapsible material is collapsed to a distance d2, less than d1. Therefore, the collapsible reducing wedge 60 is adaptable to act as a shim for various thicknesses of the legs 4, 5.

Figure 18:
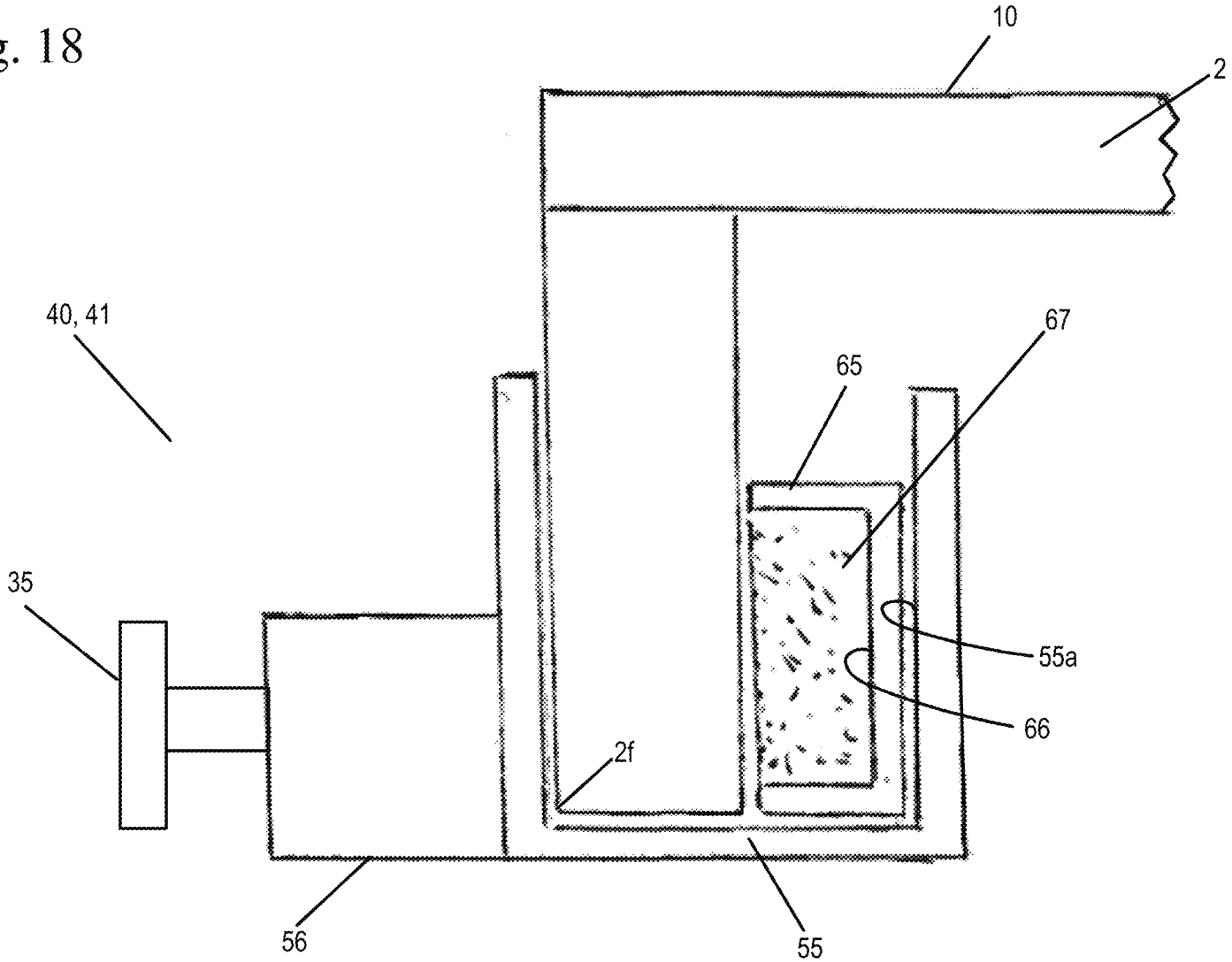
FIG. 18 shows the front leg bracket assembly with a leg of the cornhole board and reducing shim.
Figure 19:
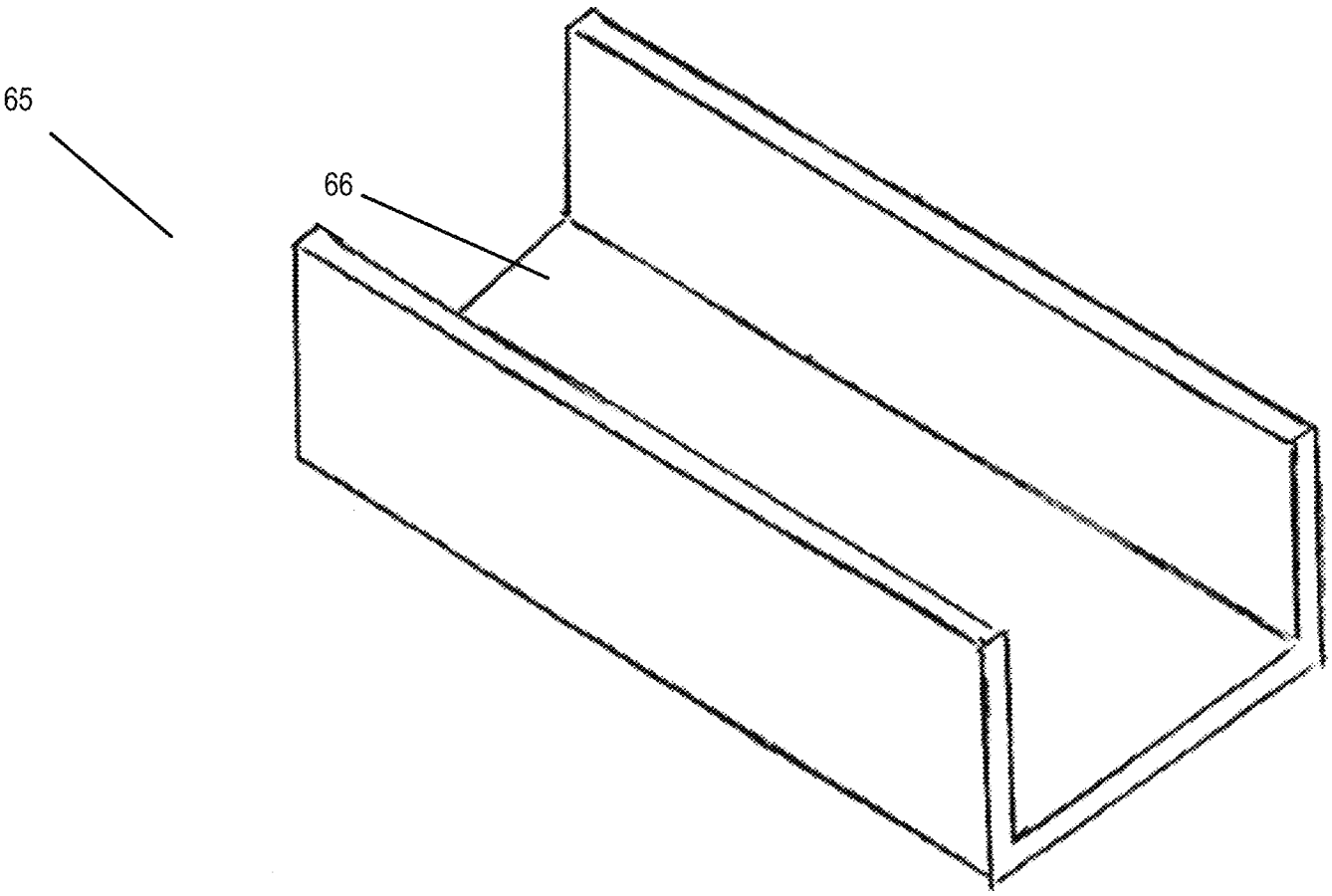
FIG. 19 shows a perspective view of the front leg bracket for holding compressible material to form a reducing shim.
Figure 20B:
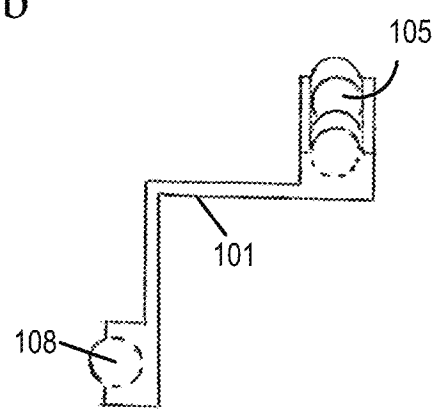
FIG. 20*b* shows a side view of the level.
Figure 20D:
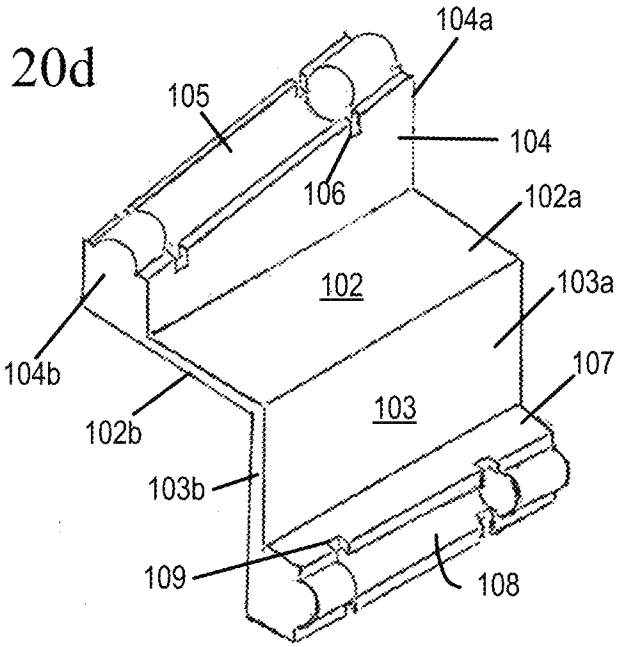
FIG. 20*d* shows a perspective view of the level.
Figure 20A:
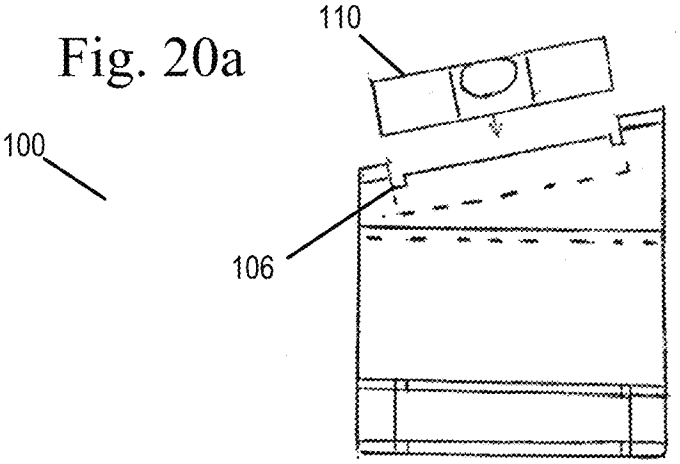
FIG. 20*a* shows a front view of the level.
Figure 20C:
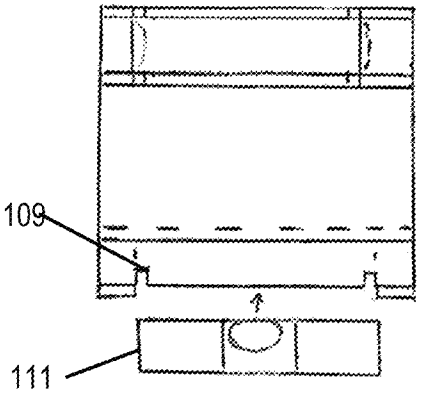
FIG. 20*c* shows a top view of the level.
Figure 21B:
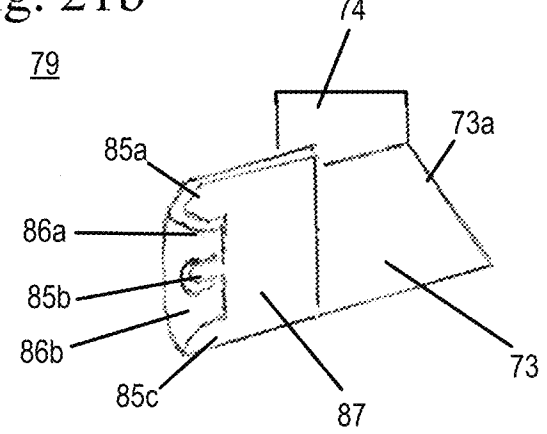
FIG. 21*b* shows a right side alignment clip.
Figure 21A:
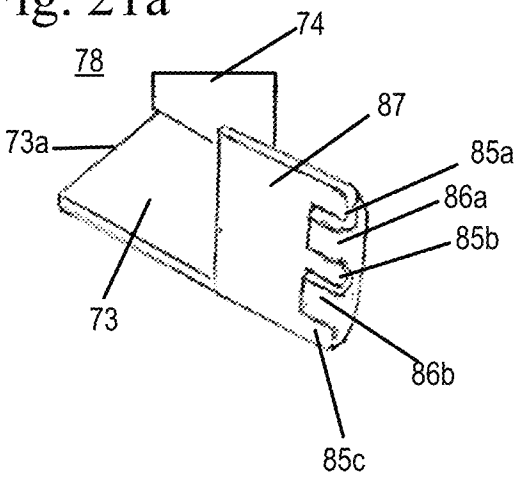
FIG. 21*a* shows a left side alignment clip.

FIGS. 18-19 show a reducing shim 65 for filling the space within the closed end bore 55*a* of the guide body of the front bracket assemblies 40, 41 after the front edge 2*f* of the cornhole board has been inserted into the closed end bore 55*a*. The reducing shim 65 has a C-shaped rigid body 65 defining an opening 66 for receiving a collapsible material 67.

FIGS. 26*a*-28 are a method of aligning and leveling cornhole boards for playing on uneven ground.

Figure 29:
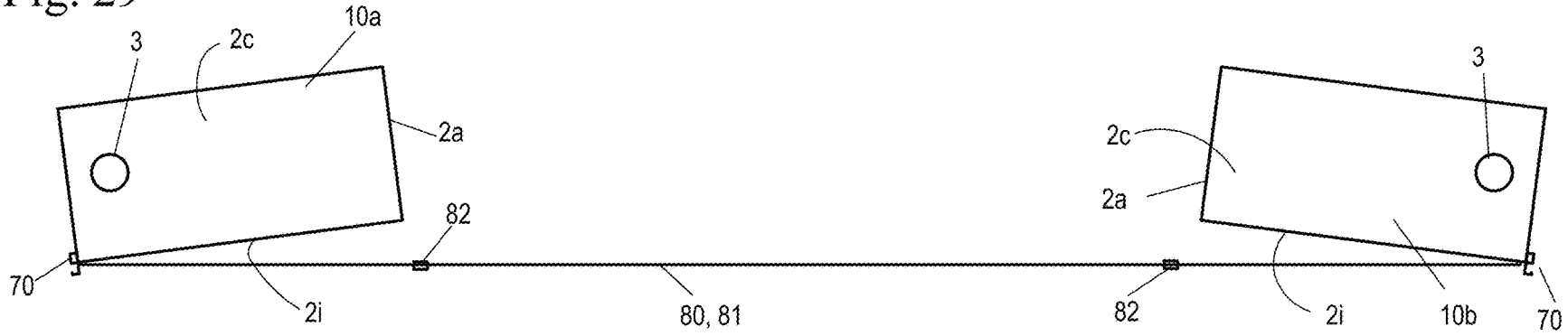
FIG. 29 shows a top view of placing the first board on the ground across from a second board, connecting alignment clips of the first and second boards using an alignment cable with the first board and second board not in alignment with a length of the alignment cable.

In a first step (step 302), a first cornhole board 10*a* is placed on the ground opposite a second cornhole board 10*b*. It is noted that the first end 2*a* of each of the first cornhole board 10*a* and the second cornhole board 10*b* face each other as shown in FIG. 29.

Figure 25C:
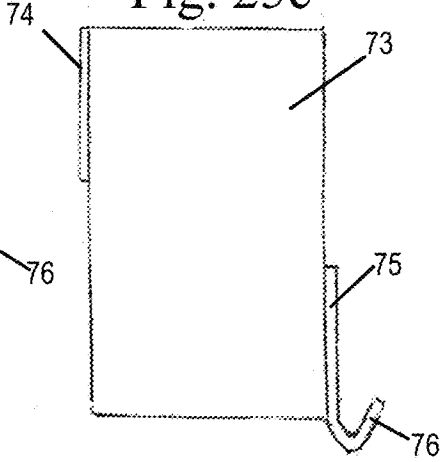
FIG. 25*c* shows a perspective view of the left surface alignment line attachment clip.
Figure 25B:
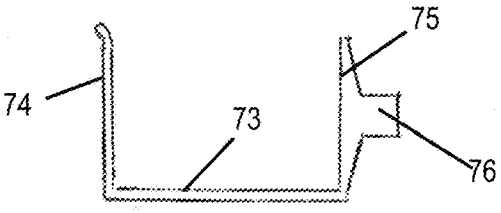
FIG. 25*b* shows a top view of the left surface alignment line attachment clip.
Figure 25A:
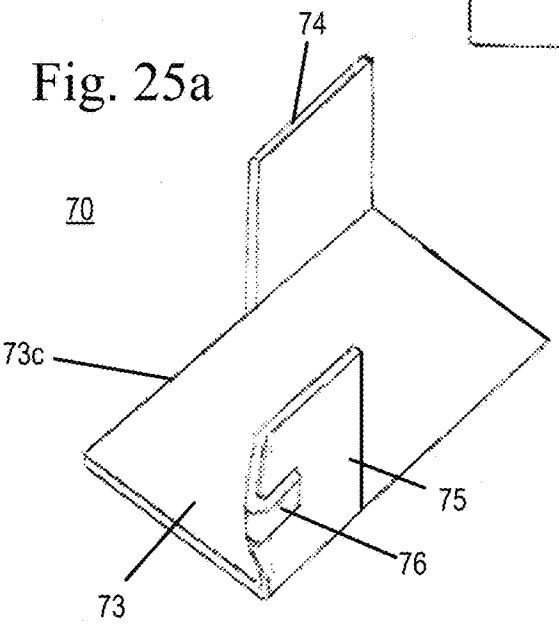
FIG. 25*a* shows a side view of the left surface alignment line attachment clip.
Figure 24C:
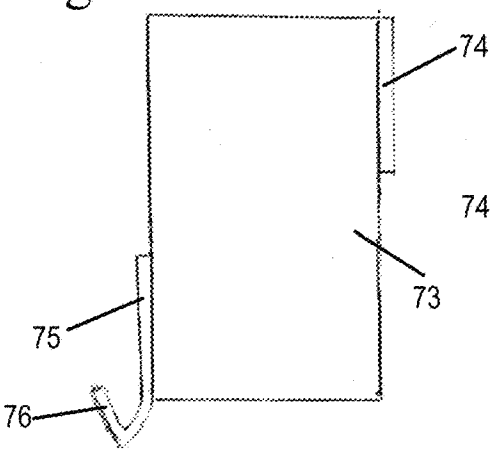
FIG. 24*c* shows a perspective view of the right surface alignment line attachment clip.
Figure 24B:
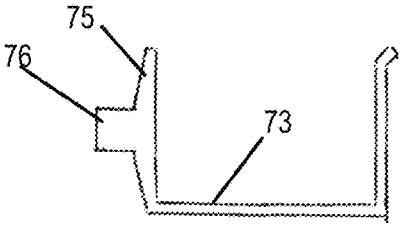
FIG. 24*b* shows a top view of the right surface alignment line attachment clip.
Figure 24A:
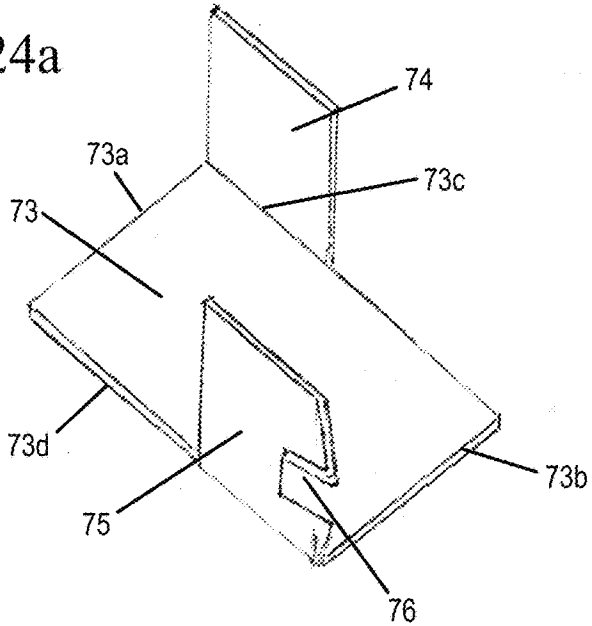
FIG. 24*a* shows a side view of the right surface alignment line attachment clip.
Figures 26A, 26B:
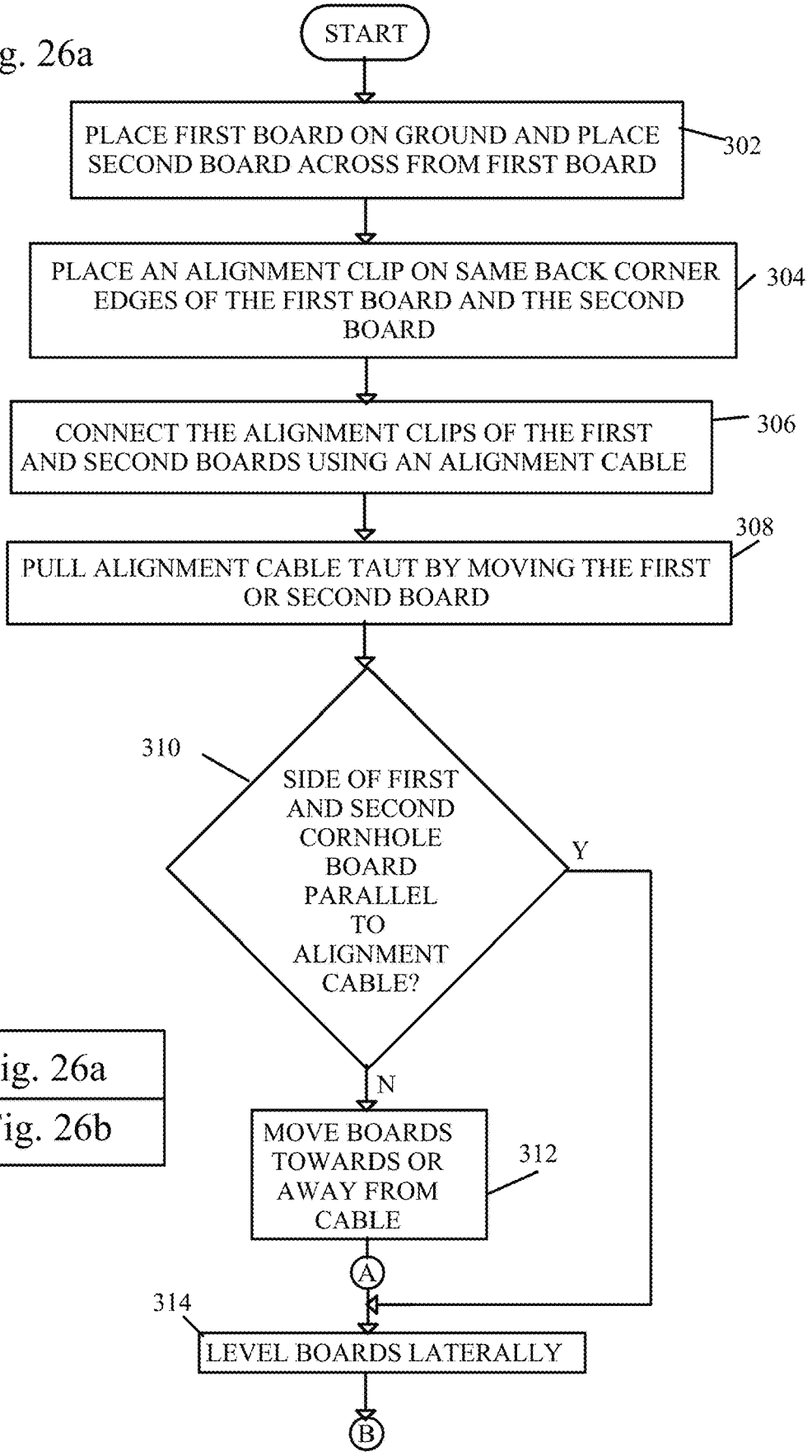
FIG. 26*a*-26*b* shows a method of leveling the cornhole board.
Figure 26B:
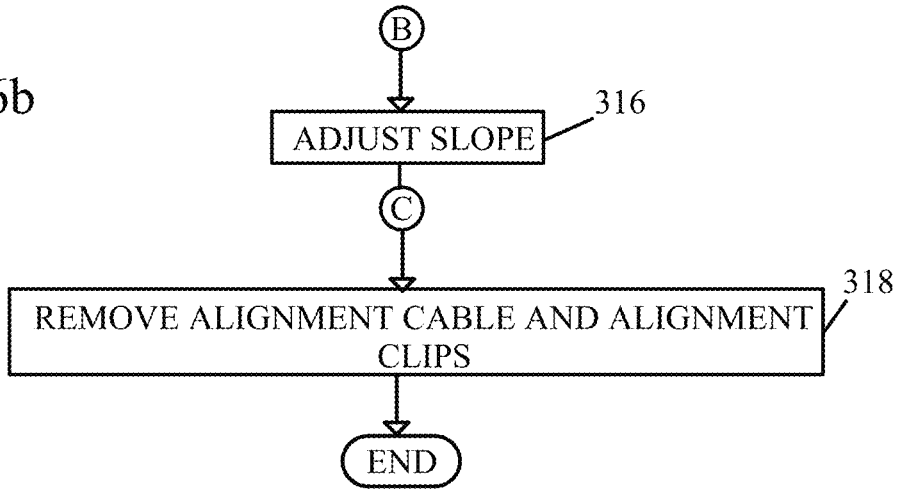

An alignment clip 70, 71, is then placed on the back corner edges 2*g* of the first and second cornhole boards 10*a*, 10*b*. FIGS. 25*a*-25*c* shows a left side alignment clip 70 and FIGS. 24*a*-24*c* shows a right side alignment clip 71 (step 304).

Figure 22B:
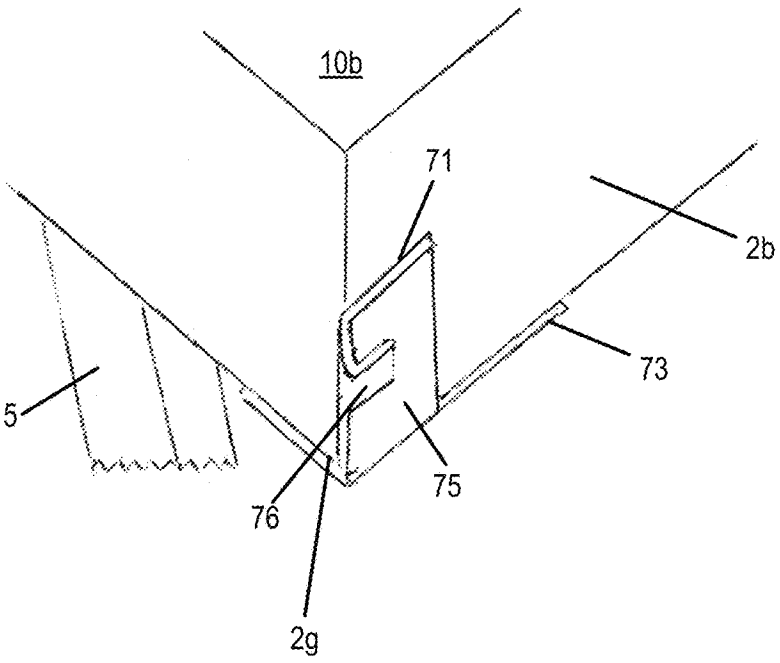
FIG. 22*b* shows a right side alignment clip on the cornhole board.
Figure 22A:
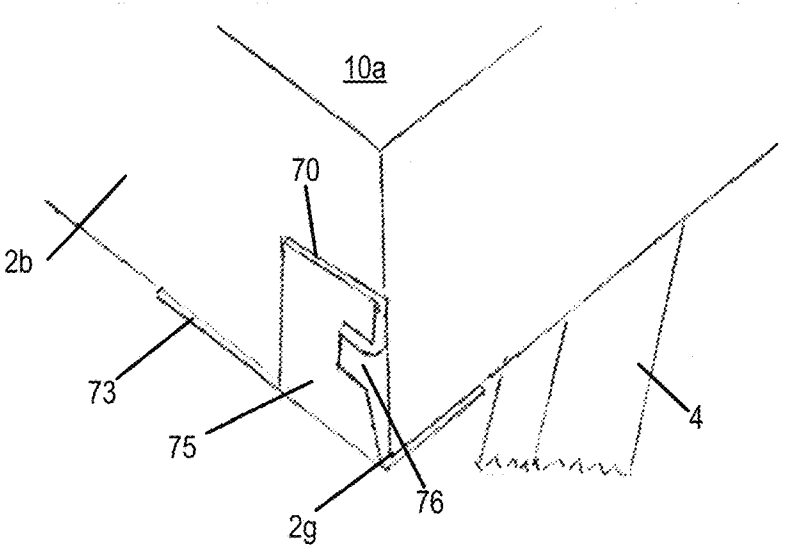
FIG. 22*a* shows a left side alignment clip on the cornhole board.

FIG. 22*a* shows the left side alignment clip 70 on back corner edge 2*g* near leg 4 of the first cornhole board 10*a*. FIG. 22*b* shows the right side alignment clip 71 on back edge 2*g* near leg 5 of the second cornhole board 10*b*. It is noted that the right side alignment clip 71 could be used near leg 4 of the first cornhole board 10*a* and the left side alignment clip 70 used near leg 5 of the second cornhole board 10*b*. It is noted that the right side alignment clip 71 is a mirror image of the left side alignment clip 70.

Referring back to FIGS. 24*a*-25*c*, the alignment clips 70, 71 each have a body 72 with a first portion 73 with a first end 73*a* and a second end 73*b* and a first side 73*c* and a second side 73*d*. Connected to the first portion 73 at the first end 73*a* on the first side 73*c* is a second portion 74. Connected to the first portion 73 at the second end 73*b* on the second side 73*d* is a third portion 75 which defines at least one hook 76.

The alignment clips 70, 71 are placed onto the cornhole boards 10*a*, 10*b* such that the corner edge 2*g* contacts the first portion 73, the second portion 74 is received underneath and behind the second end 2*b* between the leg 4, 5 and the corner edge 2*g*, and the third portion 75 is adjacent to second end 2*b*.

Referring back to FIGS. 26*a*-26*b*, the alignment clips 70, 71 attached to the first and second cornhole boards 10*a*, 10*b* are connected together using an alignment cable 80, 81 (step 306) as shown in FIG. 29.

Figure 23A:
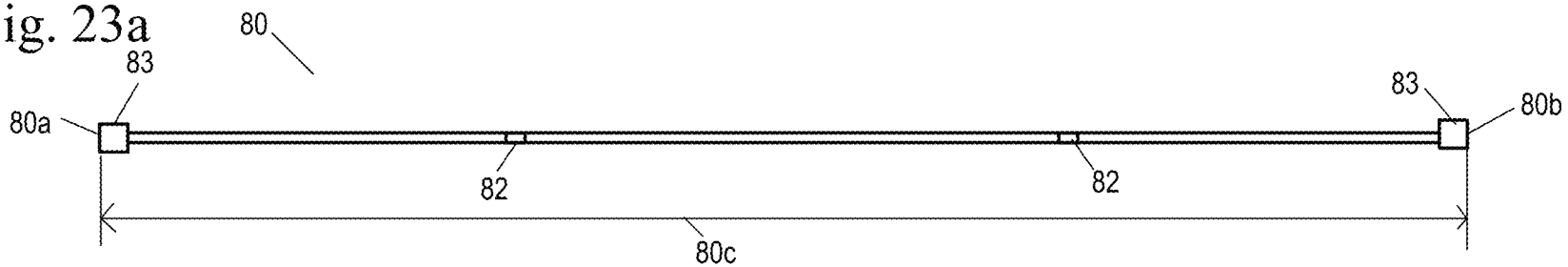
FIG. 23*a* shows an alignment cable with solid ends.
Figure 23B:
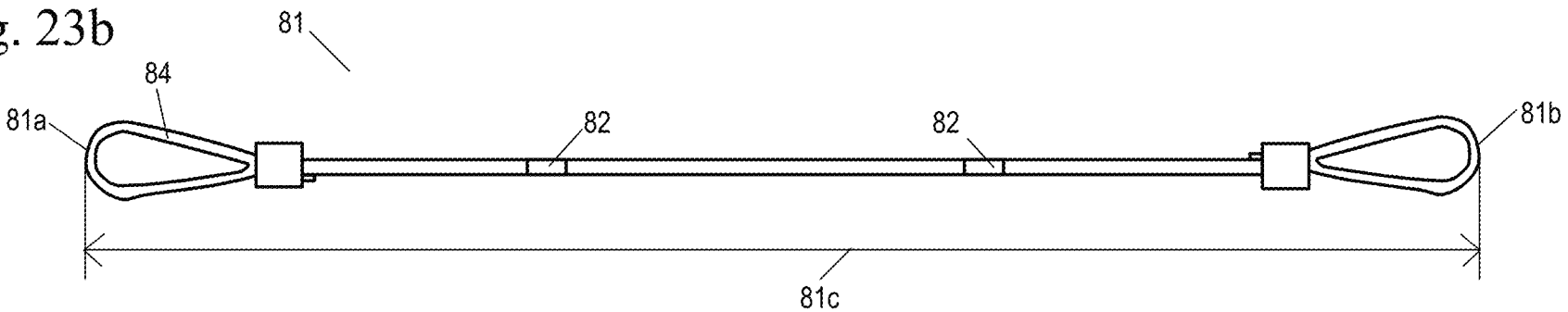
FIG. 23*b* shows an alignment cable with looped ends.

FIG. 23*b* shows an alignment cable 81 with a first end 81*a* separated from a second end 81*b* by a length 81*c*. The length 81*c* of the alignment cable can be 35 feet or 41 feet long. Markers 82 may be present along the length 81*c* of the alignment cable 81 to indicate 27 feet between each first end 2*a* of the first and second cornhole boards 10*a*, 10*b*. While not shown, the markers 82 can also indicate 33 feet between the first end 2*a* of the first cornhole board 10*a* and the first end 2*a* of the second cornhole board 2*a*. At the first end 81*a* and the second 81*b* are loops 84 that can be accepted around the hooks 76 of the alignment clips 70, 71.

Alternatively, alignment clips 78, 79 are placed onto the cornhole boards 10*a*, 10*b* in step 304. The alignment clips 78, 79 have each have a body 72 with a first portion 73 with a first end 73*a* and a second end 73*b* and a first side 73*c* and a second side 73*d*. Connected to the first portion 73 at the first end 73*a* on the first side 73*c* is a second portion 74. Connected to the first portion 73 at the second end 73*b* on the second side 73*d* is a third portion 87 which defines at least two flanges 85*a*-85*c* which define holes 86*a*, 86*b*. The alignment clips 78, 79 are placed on the cornhole boards 10*a*, 10*b*. such that the corner edge 2*g* contacts the first portion 73, the second portion 74 is received underneath and behind the second end 2*b* between the leg 4, 5 and the corner edge 2*g*, and the third portion 75 is adjacent to second end 2*b*.

FIG. 23*a* shows an alignment cable 80 with a first end 80*a* separated from a second end 80*b* by a length 80*c*. The length 80*c* of the alignment cable can be 35 feet or 41 feet long. Markers 82 may be present along the length 80*c* of the alignment cable 80 to indicate 27 feet between each first end 2*a* of the first and second cornhole boards 10*a*, 10*b*. While not shown, the markers can also indicate 33 feet between the first end 2*a* of the first cornhole board 10*a* and the first end 2*a* of the second cornhole board 2*a*. At the first end 80*a* and the second 80*b* are solid pieces 83 that can be accepted into the openings 86*a*-86*b* between the flanges 85*a*-85*c* of the alignment clips 78, 79 in step 306 to connect opposing cornhole boards 10*a*, 10*b* together.

The first and/or second cornhole boards 10*a*, 10*b* are moved to pull the alignment cable taut (step 308).

Figure 30A:
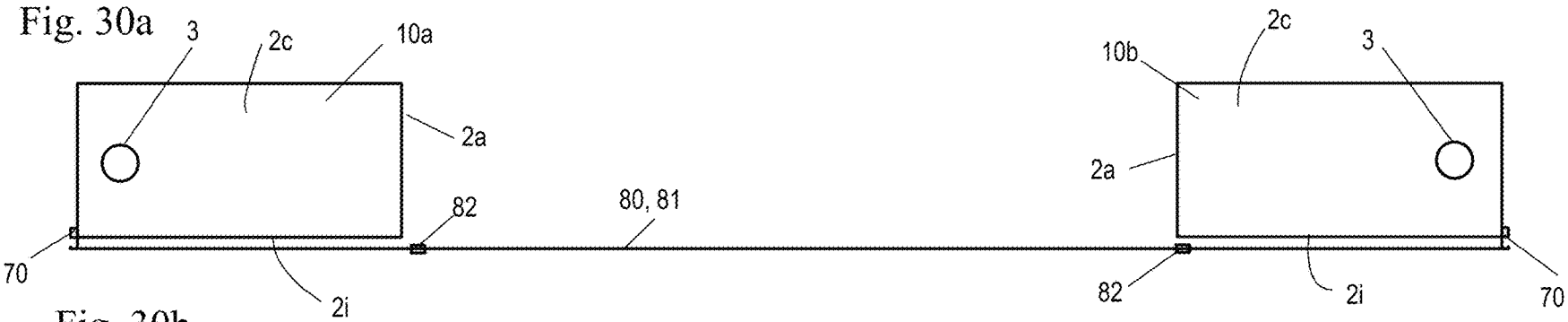
FIG. 30*a* shows a top view of the first and second boards moved to be in alignment with a length of the alignment cable.
Figure 30B:
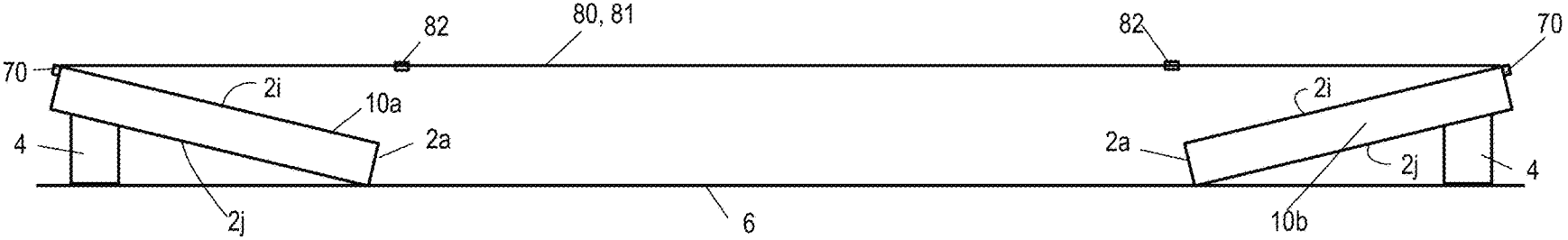
FIG. 30*b* shows a side view of FIG. 30*a*.

Next, it is determined whether the top or bottom edges 2*i*, 2*j* of the sides 2*h* of the first and second cornhole boards 10*a*, 10*b* are aligned with the length 80*c*, 81*c* of the alignment cable 80, 81 (step 310). If the top or bottom edges 2*i*, 2*j* of the sides 2*h* of the first and second cornhole boards 10*a*, 10*b* are aligned with the length 80*c*, 81*c* of the alignment cable 80, 81 as shown in FIGS. 30*a*-30*b*, the method continues to step 314. If the top or bottom edges 2*i*, 2*j* of the sides 2*h* of the first and second cornhole boards 10*a*, 10*b* are not aligned with the length 80*c*, 81*c* of the alignment cable 80, 81 as shown in FIG. 29, the cornhole boards 10*a*, 10*b* are moved laterally towards or away from the alignment cable 80, 81 (step 312) as shown in FIGS. 30*a*-30*b* and the method continues to step 314.

Figure 27:
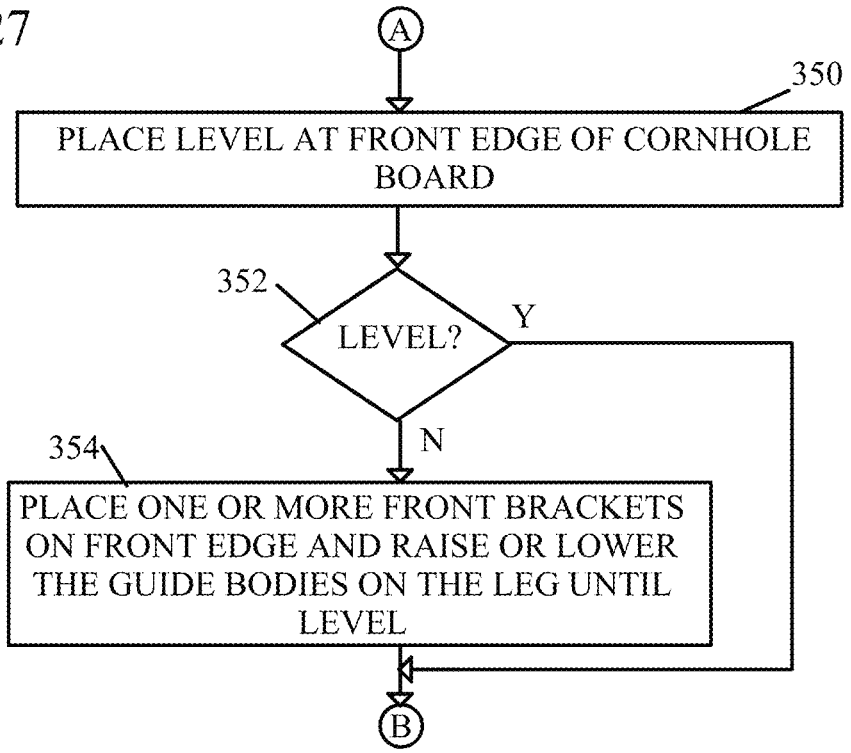
FIG. 27 shows a method of leveling the cornhole boards laterally.

The cornhole boards 10*a*,10*b* are then leveled (step 314). Referring to FIG. 27, the leveling of the cornhole boards 10*a*, 10*b* includes the sub-steps of placing a horizontal and angle slope level 100 at first end 2*a* of each of the cornhole boards 10*a*, 10*b* (step 350) and if the cornhole board 10*a*, 10*b* is not level (step 352), placing one or more front leg bracket assemblies 40, 41 on the front edge 2*f* and raising or lowering the guide bodies 55 on the front legs 54 until the cornhole board 10*a*, 10*b* is level (step 354). The screw 35 is tightened to engage the leg portion 52 to maintain the one or more front leg bracket assemblies 40, 41. The method continues to step 316.

The horizontal and angle slope level 100 is shown in FIGS. 20*a*-20*d*. The horizontal and angle slope level 100 has a body 101 which is L-shaped and has a first portion 102 connected to a second portion 103 at a right angle. The first portion 102 has an outer surface 102*a* and an inner surface 102*b*. The inner surface 103*b* contacts the cornhole board 10*a*, 10*b*. Mounted to the outer surface 102*a* of the first portion 102 is a sloped body 104 defining a bore 105 for receiving a first level 110. The sloped body 104 is higher at a first end 104*a* than the second end 104*b*. The first level 110 determines the angle slope of the cornhole boards 10*a*, 10*b* when placed on the front edge 2*f* The second portion 103 has an outer surface 103*a* and an inner surface 103*b*. Mounted to an outer surface 103*b* of the second portion 103 is a body 107 defining a bore 108 for receiving a second level 111. The second level 111 determines the horizontal slope of the cornhole boards 10*a*, 10*b*. It is noted that the which slope being measured—horizontal or angle, is determined by which level is placed adjacent to the top surface 2*c* of the cornhole board 10*a*, 10*b*. The level measuring angle slope is set to be "level" at 10 degrees.

Figure 28:
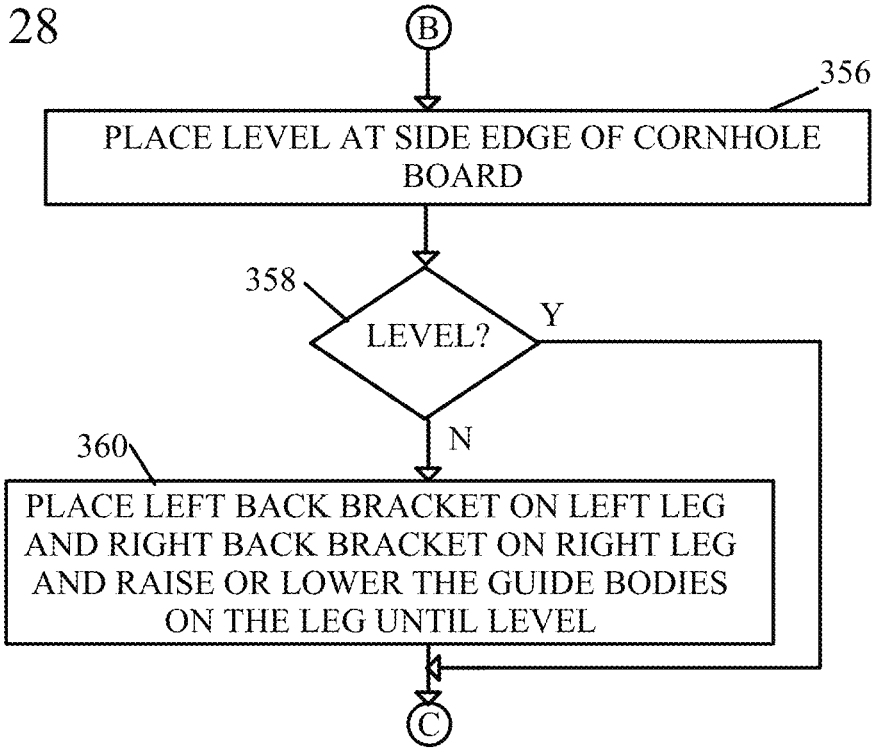
FIG. 28 shows a method of adjusting the slop of the cornhole boards.

Step 316 of adjusting the slope has sub-steps shown in FIG. 28 of placing the horizontal and angle slope level 100 at top edge 2*i* of the side 2*h* of each of the cornhole boards 10*a*, 10*b* (step 350) and if the cornhole board 10*a*, 10*b* is not level (step 356), placing the back leg bracket assemblies 20, 21 on the legs 4, 5 of the cornhole boards 10*a*, 10*b* and raising or lowering the left back bracket guide 30 on left leg 29 and the right back leg bracket guide 29 on right leg 22 until the cornhole board 10*a*, 10*b* is level (step 360). Screws 35 are tightened to engage the right leg 22 and the left leg 29 to maintain the back bracket assemblies 20, 21. The method continues to step 318.

The alignment cable, alignment clips and level are removed (step 318) and the method ends.

It is noted that a kit for leveling one or more cornhole boards would include front leg bracket assemblies 40, 41, back leg bracket assemblies 20, 21 and the horizontal and angle slope level 100.

It is noted that a kit for aligning and leveling cornhole boards for playing on uneven ground would include front leg bracket assemblies 40, 41, back leg bracket assemblies 20, 21, the horizontal and angle slope level 100, alignment cables 80, 81 and alignment clips 78, 79, 70, 71.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A kit for leveling one or more cornhole boards comprising:

at least one pair of back leg bracket assemblies comprising:

a right leg bracket assembly comprising: a right leg having a right leg portion connected to a right leg base portion at a first angle; a right back leg bracket guide having a right leg guide body defining a closed end bore adapted to receive a right leg of a back of one or more cornhole boards and connected to a right leg guide defining a right leg through bore and a right leg screw bore perpendicular to and connected to the right leg through bore adapted to receive a screw; wherein the right leg portion of the right leg is received within the right leg through bore, such that the right leg guide is vertically adjustable about the right leg portion;

a left leg bracket assembly comprising: a left leg having a left leg portion connected to a left leg base portion at a second angle; a left back leg bracket guide having a left leg guide body defining a closed end bore adapted to receive a left leg of a back of one or more cornhole boards and connected to a left leg guide defining a left leg through bore and a left leg screw bore perpendicular to and connected to the left leg through bore adapted to receive a screw; wherein the left leg portion of the left leg is received within the left leg through bore, such that the left leg guide is vertically adjustable about the left leg portion; and one or more front leg bracket assemblies each comprising:

a front leg having a front leg portion connected to a front leg base portion at a third angle;

a front leg bracket guide body defining a closed end bore adapted to receive a front edge of the at least one cornhole boards comprising a guide body defining a guide body closed end bore and connected to a front leg bracket leg guide defining a through bore and a screw bore perpendicular to and connected to the through bore to receive a screw; wherein the front leg portion of the front leg is received within the through bore, such that the front leg bracket leg guide is vertically adjustable about the front leg.

2. The kit of claim 1, wherein the first angle and the second angle are 27 degrees.

3. The kit of claim 1, wherein the first angle and the second angle are between 20 to 30 degrees.

4. The kit of claim 1, wherein the left leg further comprises: a left leg base portion attached to the left leg on a left leg base portion first surface and adapted to engage a ground surface on a left leg base portion second surface and the right leg further comprises a right leg base portion attached to the right leg on a right leg base portion first surface and adapted to engage a ground surface on a right leg base portion second surface.

5. The kit of claim 1, further comprising a collapsible reducing wedge comprising a rigid shim plate attached to a collapsible material for insertion within the closed end bore of the right leg guide body and/or the closed end bore of the left leg guide body.

6. The kit of claim 1, further comprising a reducing shim comprising a C-shaped rigid body defining an opening for receiving a collapsible material, the reducing shim being received in the closed end bore of the front leg bracket guide body of the one or more front leg bracket assemblies.

7. The kit of claim 1, further comprising a horizontal and angle slope level comprising: an L-shaped body having a first portion with a sloped body defining a first level bore receiving a first level measuring a slope angle of the one or more cornhole boards and a second portion with a body defining a second level bore receiving a second level measuring a horizontal level between side edges of the one or more cornhole boards.

8. A kit for leveling a first cornhole board and a second cornhole board and setting a regulation distance between the first cornhole board and the second cornhole board, the kit comprising:

a pair of back leg bracket assemblies for each of the first cornhole board and the second cornhole board comprising:

a right leg bracket assembly comprising: a right leg having a right leg portion connected to a right leg base portion at a first angle; a right back leg bracket guide having a right leg guide body defining a closed end bore adapted to receive a right leg of a back of one or more cornhole boards and connected to a right leg guide defining a right leg through bore and a right leg screw bore perpendicular to and connected to the right leg through bore adapted to receive a screw; wherein the right leg portion right leg is received within the right leg through bore, such that the right leg guide is vertically adjustable about the right leg portion;

a left leg bracket assembly comprising: a left leg having a left leg portion connected to a left leg base portion at a second angle; a left back leg bracket guide having a left leg guide body defining a closed end bore adapted to receive a left leg of a back of one or more cornhole boards and connected to a left leg guide defining a left leg through bore and a left leg screw bore perpendicular to and connected to the left leg through bore adapted to receive a screw; wherein the left leg portion of the left leg is received within the left leg through bore, such that the left leg guide is vertically adjustable about the left leg portion;

one or more front leg bracket assemblies for each of the first cornhole board and the second cornhole board, each front leg bracket assembly comprising:

a front leg having a front leg portion connected to a front leg base portion at a third angle;

a front leg bracket guide body defining a closed end bore adapted to receive a front edge of the at least one cornhole boards comprising a guide body defining a guide body closed end bore and connected to a front leg bracket leg guide defining a through bore and a screw bore perpendicular to and connected to the through bore to receive a screw; wherein the front leg portion of the front leg is received within the through bore, such that the front leg bracket leg guide is vertically adjustable about the front leg; and an alignment cable having a first end and a second end separated by a length, the first end and the second end each having a retainer;

a left side alignment clip adapted to mount to a left side of the first cornhole board, the left side alignment clip comprising: a left side alignment clip body with an a left side alignment clip first portion having a first end, a second end opposite the first end, a first side and a second side opposite the first side, a left side alignment clip second portion connected to the left side alignment clip first portion at the first end on the first side; and a left side alignment clip third portion connected to the left side alignment clip first portion at the second end on the second side defining at least one left side alignment piece; and a right side alignment clip adapted to mount to a right side of the second cornhole board, the right side alignment clip comprising: a right side alignment clip body with an a right side alignment clip first portion having a first end, a second end opposite the first end, a first side and a second side opposite the first side, a right side alignment clip second portion connected to the right side alignment clip first portion at the first end on the first side; and a right side alignment clip third portion connected to the right side alignment clip first portion at the second end on the second side defining at least one right side alignment piece.

9. The kit of claim 8, wherein the right side alignment piece is at least one right side hook and the left side alignment piece is at least one left side hook.

10. The kit of claim 9, wherein the retainer is a loop received by the at least one right side hook and the at least one left side hook.

11. The kit of claim 8, wherein the alignment cable further comprises markers along the length indicated 27 feet between the first cornhole board and the second cornhole board.

12. The kit of claim 8, wherein the right side alignment piece is at least two right side flanges defining a plurality of holes and the left side alignment piece is at least two left side flanges defining a plurality of holes.

13. The kit of claim 12, wherein the retainer is a solid piece received within one of the plurality of openings defined by the at least two right side flanges and the at least two left side flanges.

14. The kit of claim 8, further comprising a horizontal and angle slope level comprising: an L-shaped body having a first portion with a sloped body defining a first level bore receiving a first level measuring a slope angle of the one or more cornhole boards and a second portion with a body defining a second level bore receiving a second level measuring a horizontal level between side edges of the one or more cornhole boards.

15. The kit of claim 8, further comprising a collapsible reducing wedge comprising a rigid shim plate attached to a collapsible material for insertion within the closed end bore of the right leg guide body and/or the closed end bore of the left leg guide body.

16. The kit of claim 8, further comprising a reducing shim comprising a C-shaped rigid body defining an opening for receiving a collapsible material, the reducing shim being received in the closed end bore of the front leg bracket guide body of the one or more front leg bracket assemblies.

17. The kit of claim 8, further comprising a horizontal and angle slope level comprising: an L-shaped body having a first portion with a sloped body defining a first level bore receiving a first level measuring a slope angle of the one or more cornhole boards and a second portion with a body defining a second level bore receiving a second level measuring a horizontal level between side edges of the one or more cornhole boards.

18. A method of aligning and leveling a first cornhole board and a second cornhole board for playing on uneven ground comprising:

placing the first cornhole board on the uneven ground opposite a second cornhole board on the uneven ground, such that a first end of the first cornhole board is facing a first end of the second cornhole board;

placing a first alignment clip on a left side back corner edge of the first cornhole board and a second alignment clip on a right side back corner edge of the second cornhole board;

connect the first alignment clip of the first cornhole board to the second alignment clip of the second cornhole board with an alignment cable;

moving the first cornhole board or the second cornhole board to pull the alignment cable taut while connected to the first alignment clip and the second alignment clip;

aligning first cornhole board edges and second cornhole board edges with a length of the alignment cable through lateral movement of the first cornhole board and the second cornhole board;

leveling the first cornhole board and the second cornhole board with a level;

adjusting a slope of the first cornhole board and the second cornhole board; and removing the alignment cable, alignment clips and the level from the first cornhole board and second cornhole board.

19. The method of claim 18, wherein leveling the first cornhole board and the second cornhole board with the level comprises: placing a horizontal and angle slope level at the first end of each of the first and second cornhole boards and when either of the first cornhole board or the second cornhole board is not level, placing one or more front leg bracket assemblies on a front edge of the first cornhole board and/or the second cornhole board and raising or lowering guide bodies on one or more front legs of the front leg bracket assemblies until the first cornhole board and/or the second cornhole board is level; and tightening a screw received within the guide bodies to engage a leg portion of the one or more front legs to maintain the one or more front leg bracket assemblies in place.

20. The method of claim 18, wherein adjusting the slope of the first cornhole board and the second cornhole board comprises:

placing a horizontal and angle slope level at a top edge of a side of each of the first cornhole board and the second cornhole board, and when either of the first cornhole board and/or the second cornhole board is not level, placing a right back leg bracket assembly on a right back leg of the first and/or second cornhole boards, placing a left back leg bracket assembly on a left back leg and raising or lowering a left back bracket guide of the left back leg bracket assembly on the left leg and a right back leg bracket guide of the right back leg bracket assembly on the right leg until the first and/or second cornhole boards are level; tightening a screw received within the right back leg bracket guide to engage a right leg portion of the right leg to maintain the right back leg bracket assembly in place; and tightening a screw received within the left back leg bracket guide to engage a left leg portion of the left leg to maintain the left back leg bracket assembly in place.

* * * * *